US010814614B2

(12) United States Patent
Tamura et al.

(10) Patent No.: US 10,814,614 B2
(45) Date of Patent: Oct. 27, 2020

(54) PRINTING DEVICE FOR TRANSFERRING IMAGE FROM TRANSFER FILM TO RECORDING MEDIUM

(75) Inventors: Hiromitsu Tamura, Yamanashi (JP); Tsuyoshi Kubota, Yamanashi (JP); Yuichi Aihara, Yamanashi (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 809 days.

(21) Appl. No.: 13/811,055

(22) PCT Filed: Jul. 21, 2011

(86) PCT No.: PCT/JP2011/066615
§ 371 (c)(1),
(2), (4) Date: Mar. 14, 2013

(87) PCT Pub. No.: WO2012/011540
PCT Pub. Date: Jan. 26, 2012

(65) Prior Publication Data

US 2013/0167742 A1 Jul. 4, 2013

(30) Foreign Application Priority Data

Jul. 22, 2010 (JP) ..... 2010-165319
Apr. 28, 2011 (JP) ..... 2011-102455
Apr. 28, 2011 (JP) ..... 2011-102456

(51) Int. Cl.
*B41J 11/00* (2006.01)
*B41J 2/325* (2006.01)
(Continued)

(52) U.S. Cl.
CPC ..... *B41F 16/0033* (2013.01); *B41J 2/0057* (2013.01); *B41J 13/12* (2013.01);
(Continued)

(58) Field of Classification Search
CPC ..... B41J 2/325
See application file for complete search history.

(56) References Cited

U.S. PATENT DOCUMENTS 2,737,089 A * 3/1956 Baumgartner ..... B65H 23/34 101/228
4,887,096 A * 12/1989 Asakura et al. ..... 347/216
(Continued)

FOREIGN PATENT DOCUMENTS

JP 05208533 A * 8/1993
JP H07-227980 A 8/1995
(Continued)

OTHER PUBLICATIONS

PCT, "International Search Report for PCT/JP2011/066615", dated Nov. 1, 2011.

*Primary Examiner* — Jill E Culler
(74) *Attorney, Agent, or Firm* — Manabu Kanesaka

(57) ABSTRACT

Provided are a transfer roller 33 that transfers an image formed on a transfer film 46 to a card, peeling member 34*b* that peels off the transfer film 46 from the card after transferring the image, and transfer roller up-and-down means 61 and peeling member up-and-down means 62 for respectively moving the transfer roller 33 and the peeling member 34*b* up and down. By this means, the transfer roller 33 and the peeling member 34*b* are moved up and down respectively at predetermined timing before transfer and after transfer, and it is thereby possible to always perform stable image formation without causing the transfer film to become damaged and/or deformed.

16 Claims, 13 Drawing Sheets

(51) Int. Cl.

| | |
|---|---|
| ***B65H 23/34*** | (2006.01) |
| ***B41F 16/00*** | (2006.01) |
| ***B41J 2/005*** | (2006.01) |
| ***B41J 13/12*** | (2006.01) |

(52) U.S. Cl.
CPC ..... *B41J 2/325* (2013.01); *B41J 11/0005* (2013.01); *B65H 23/34* (2013.01)

(56) References Cited

U.S. PATENT DOCUMENTS

| | | | | |
|---|---|---|---|---|
| 5,708,467 | A * | 1/1998 | Yoshikawa et al. | 347/213 |
| 6,157,399 | A | 12/2000 | Miyaji et al. | |
| 6,640,717 | B2 * | 11/2003 | Kosaka et al. | 101/487 |
| 6,801,236 | B2 * | 10/2004 | Araki et al. | 347/213 |
| 2003/0025781 | A1 * | 2/2003 | Honma et al. | 347/213 |
| 2009/0190984 | A1 * | 7/2009 | Yamamoto | B41J 11/0005 399/406 |
| 2011/0001785 | A1 * | 1/2011 | Tsuzawa | B41J 11/0005 347/104 |

FOREIGN PATENT DOCUMENTS

| | | | |
|---|---|---|---|
| JP | H08-276646 | A | 10/1996 |
| JP | H10-119360 | A | 5/1998 |
| JP | H11-268311 | A | 10/1999 |
| JP | 2000-141727 | A | 5/2000 |
| JP | 2001-270099 | A | 10/2001 |
| JP | 2002-096510 | A | 4/2002 |
| JP | 2005-96476 | A | 4/2005 |
| JP | 2006-321069 | A | 11/2006 |

* cited by examiner

PRINTING DEVICE FOR TRANSFERRING IMAGE FROM TRANSFER FILM TO RECORDING MEDIUM

TECHNICAL FIELD

The present invention relates to a printing device for transferring an image on a transfer film to a recording medium such as a card, and more particularly, to a printing device and printing method for enabling image transfer to a recording medium and peeling of a film from the transferred recording medium to be handled reliably.

BACKGROUND ART

Generally, this type of device is widely known as a device for forming images such as a photograph of face and character information on media such as a plastic card. In this case, known are a device configuration for directing forming an image on a recording medium and another device configuration for forming an image on a transfer film and transferring the image to a recording medium.

In the latter case of the device configuration for transferring an image formed on the transfer film to a recording medium in a platen section, it is necessary to peel off the transfer film from the recording medium in a rear end portion of the recoding medium.

For example, Patent Document 1 discloses a device in which a transfer roller (heat roller) and film guide members are made a unit and disposed in a position opposed to a platen, and the guide members are disposed on the upstream side and downstream side of the platen as a pair to support the transfer film. Then, the unit loaded with a transfer film is brought into press-contact with the surface of the card fed to the platen, together with the transfer roller, and after finishing transfer, the transfer film and unit are separated from the card.

In the device of Document 1, at timing at which the card front end is transported to the platen, the transfer film and transfer roller are concurrently brought into press-contact, and after the card rear end passes through the film guide on the downstream side, the unit and transfer film are separated from the platen.

Further, Patent Document 2 discloses a device in which film guide members disposed on the upstream side and downstream side of the platen are fixed, the transfer film is loaded in between the guide members, and the transfer roller is brought into press-contact and separated with/from the platen. Then, the transfer roller is separated from the platen at timing at which the card rear end passes through the roller.

Furthermore, Patent Document 3 discloses a device in which a peeling member is disposed outside a cassette, separately from the unit loaded with the transfer film.

PRIOR ART DOCUMENT

Patent Document

Patent Document 1: Japanese Patent Application Publication No. 2005-096476

Patent Document 2: Japanese Patent Application Publication No. 2000-141727

Patent Document 3: Japanese Patent Application Publication No. 1-108-276646

SUMMARY OF THE INVENTION

Problems to be Solved by the Invention

As described above, in the image formation mechanism in which the transfer film is installed to come into press-contact with the recording medium and travel on the platen, and an image on the transfer film is transferred to the recording medium by the transfer roller, a peeling member for peeling off the film of which the image is transferred from the recording medium is needed on the downstream side of the platen. This peeling member is formed from a roller with a small diameter or pin member so as to reliably fit the film with the recording medium and concurrently prevent damage.

Therefore, conventionally, adopted is either the method for retracting the peeling member from the recording medium concurrently with the transfer roller after image formation (the method of Patent Document 1) or the method for fixing the peeling member and retracting only the transfer roller from the recording medium (the method of Patent Document 2). In addition, Patent Document 3 as described previously discloses a mechanism for shifting the peeling member up and down separately from the transfer member, but does not suggest timing for shifting the peeling member.

In the method of Patent Document 1 as described above, the transfer roller (heat roller) is kept in the state in contact with the transfer film still after the rear end of the recording medium passes through the transfer section of the platen. Therefore, there is the risk that the transfer roller burns or thermally deforms the transfer film base. Meanwhile, so as to avoid the risk, when the transfer roller and peeling member are retracted at timing at which the rear end of the recording medium passes through the transfer section of the platen, the peeling angle of the film is different between the front end side and the rear end side of the recording medium, resulting in a cause of providing unevenness in image.

Further, in the method of Patent Document 2 as described above, the film peeling angle of the peeling member is certain on the front end side and the rear end side of the recording medium, but the peeling member is made of a roller with a small diameter, pin or the like, and therefore, it is not possible to transport the recording medium with the image formed backward to the platen. For example, in the case of forming images on both surfaces on the frontside and backside of the recording medium, it is not possible to reverse the side on the downstream side of the platen to return (transport backward) to the platen again after forming the image on the frontside on the platen. This is because the transfer film becomes damaged by the end surface of the recording medium traveling backward.

Furthermore, in Patent Document 1, before image formation, the transfer film and the peeling member are shifted at the same time to come into press-contact with the card after aligning the card and the transfer film. In such a configuration, even when the card and the transfer film are fed and aligned before transfer, there is a defect that the transfer film is pulled out excessively when the film path changes by the transfer roller and the peeling member shifting and pressing the transfer film for transfer, and that the position of the transfer film varies.

At this point, if a certain amount is always pulled out, it is possible to prevent the printing start position from being varied, by aligning with the amount considered. However, there is a case that the used transfer film is pulled out of the wound spool side due to overrun by inertia in pulling out and/or balance between film amounts wound on the supply side and the winding side, the amount of the transfer film shifting by the change of the path is not constant, and the printing start position with respect to the card has not been stabilized.

If a configuration is implemented as shown in FIG. 20 in which a transfer roller 90 and peeling member (not shown) are shifted with a transfer film 97 pressed against a platen roller 91, are aligned with each other by a film beginning sensor 93 detecting a film beginning mark 94 and a card beginning sensor 95 detecting the front end of the card, synchronization is thereby acquired between a transfer portion 92 of the transfer film and the card 96, and the transfer roller and the transfer portion are fed into a nip portion to transfer, the film path does not change after alignment processing for the card and the transfer, but since the transfer roller contacts portions except the transfer region of the transfer film for a long time, there is a defect that the transfer film becomes damaged.

It is an object of the present invention to provide a printing device for moving a transfer roller and a peeling member up and down at correct timing before transfer and after transfer, and thereby enabling stable image formation to be performed always without causing a transfer film to become damaged and/or deformed in a device for transferring an image formed on the transfer film to a recording medium with the transfer roller.

Means for Solving the Problem

To attain the above-mentioned object, the invention provides a printing device for forming an image on a card-shaped recording medium characterized by having a medium transport path in which the recording medium is transported, an image formation section, provided on the medium transport path, having a platen, medium transport means for transporting the recording medium to the image formation section, a film unit that transports a transfer film to the image formation section, a transfer roller that transfers an image formed on the transfer film to the recording medium, transfer roller up-and-down means for moving the transfer roller up and down between an actuation position in press-contact with the recording medium in the image formation section and a retracted position separated therefrom, a peeling member disposed on the downstream side in a medium transport direction of the transfer roller to peel off the transfer film of which the image is transferred in the image formation section from the recording medium, peeling member up-and-down means for moving the peeling member up and down between an actuation position for peeling off the transfer film of which the image is transferred to the recording medium and a retracted position separated from the recording medium, and control means for controlling the transfer member up-and-down means and the peeling member up-and-down means, where the control means shifts the transfer roller from the actuation position to the retracted position after the rear end of the recording medium passes through the transfer roller, and shifts the peeling member from the actuation position to the retracted position after the rear end of the recording medium passes through the peeling member.

In the invention, the film unit is comprised of a unit frame attached to a device frame to be attachable and detachable, a pair of spools provided on the unit frame to wind the transfer film, a guide member that guides the transfer film wound around the pair of spools toward the image formation section, and the peeling member that peels off the transfer film of which the image is transferred in the image formation section from the recording medium, and the peeling member may be attached to the unit frame to be able to shift between the actuation position for peeling off the transfer film of which the image is transferred to the recording medium and the retracted position separated from the recording medium.

Further, the transfer roller and the peeling member are respectively attached to the device frame and a unit frame of the transfer unit to be able to shift between respective actuation positions and respective retracted positions, and the transfer member up-and-down means and the peeling member up-and-down means may be comprised of a first shift member that shifts the transfer roller between the actuation position and the retracted position, a second shift member that shifts the peeling member between the actuation position and the retracted position, and a common drive motor that drives the first and second shift members.

Furthermore, the invention provides a printing device for transferring an image from a transfer film to a card-shaped recording medium characterized by having a medium transport path in which the recording medium is transported, an image formation section, provided on the medium transport path, having a platen, medium transport means for transporting the recording medium to the image formation section, film transport means for transporting the transfer film to the image formation section, a film path formed by the film transport means, a transfer roller that transfers an image information record portion formed on the transfer film to the recording medium, transfer roller up-and-down means for moving the transfer roller up and down between an actuation position in press-contact with the recording medium in the image formation section and a retracted position separated therefrom, a peeling member disposed on the downstream side in a medium transport direction of the transfer roller to peel off the transfer film of which the image is transferred in the image formation section from the recording medium, peeling member up-and-down means for moving the peeling member up and down between an actuation position for peeling off the transfer film from the recording medium with the film path brought into contact with the medium transport path and a retracted position separated from the medium transport path, and control means for controlling the medium transport means, the film transport means, the transfer member up-and-down means and the peeling member up-and-down means, where the control means transports the recording medium and the transfer film to the image formation section to perform alignment processing for the recording medium and the image information record portion after shifting the peeling member to the actuation position, and after the processing, shifts the transfer roller to the actuation position to perform transfer processing.

Then, the device further has detection means for detecting a stop position of the image information record portion in the alignment processing, and the control means is characterized by after transporting the image formation record portion of the transfer film to the image formation section to align in the alignment processing, correcting a transport amount of the recording medium to the transfer start position corresponding to a detection result of the detection means, and transporting the recording medium to the image formation section.

In addition, it may be configured that the recording medium transport means is driven by a stepping motor and that the film transport means is driven by a DC motor.

Further, the invention provides a printing device for transferring an image from a transfer film to a card-shaped recording medium characterized by having a medium transport path in which the recording medium is transported, an image formation section, provided on the medium transport path, having a platen, medium transport means for transporting the recording medium to the image formation section, film transport means for transporting the transfer film to the image formation section, a film path formed by the film transport means, a transfer roller that transfers an image information record portion formed on the transfer film to the recording medium, transfer roller up-and-down means for moving the transfer roller up and down between an actuation position in press-contact with the recording medium in the image formation section and a retracted position separated therefrom, a peeling member disposed on the downstream side in a medium transport direction of the transfer roller to peel off the transfer film of which the image is transferred in the image formation section from the recording medium, peeling member up-and-down means for moving the peeling member up and down between an actuation position for peeling off the transfer film from the recording medium with the film path brought into contact with the medium transport path and a retracted position separated from the medium transport path, and control means for controlling the medium transport means, the film transport means, the transfer member up-and-down means and the peeling member up-and-down means, where the control means transports the recording medium and the transfer film to the image formation section to perform alignment processing for the recording medium and the image information record portion after shifting the peeling member to the actuation position, shifts the transfer roller to the actuation position to start transfer processing after the alignment processing, shifts the transfer roller from the actuation position to the retracted position after the rear end of the recording medium passes through the transfer roller, and shifts the peeling member from the actuation position to the retracted position after the rear end of the recording medium passes through the peeling member.

Advantageous Effect of the Invention

In the invention, the transfer roller disposed in the image formation section and the peeling member disposed on the downstream side are configured to move up and down between respective actuation positions in press-contact with the recording medium and respective retracted positions separated from the actuation positions, the transfer roller is shifted from the actuation position to the retracted position after the rear end of the recording medium passes through the transfer roller, the peeling member is shifted from the actuation position to the retracted position after the rear end of the recording medium passes through the peeling member, and therefore, the invention produces the following effects.

Since the transfer roller is retracted from the state in press-contact with the recording medium at timing at which the rear end of the recording medium passes through the image formation section, the transfer film separates from the transfer roller, and is neither damaged nor thermally deformed. Accordingly, the film base of the transfer film is neither distorted nor affects successive image formation.

Further, the transfer film traveling whine being brought into press-contact with the recording medium is peeled off from the recording medium by the peeling member, and at this point, since the peeling member is shifted from the actuation position for bringing the film into press-contact with the recording medium to the retracted position for peeling off after the rear end of the recording medium passes through, the film of which the image is transferred is peeled off in the same angle direction over from one end to the other end of the recording medium. Accordingly, a uniform image without unevenness in image is formed over the entire recording medium.

Furthermore, in the invention, the transfer unit loaded with the transfer film is installed into the device frame to be attachable and detachable, the peeling member is attached to the unit frame to be able to shift between the actuation position and the retracted position, the peeling member is thereby capable of being removed from the device frame together with the unit frame, and in this state, it is possible to remove the transfer film from the spools of the unit and newly insert. Particularly, when the peeling member is installed in the device body, insertion of the transfer film is bother, and in contrast thereto, the insertion is easy.

Still furthermore, the peeling member is shifted before thermal transfer action of the transfer roller in transfer so that the transport path of the transfer film contacts the transport path of the card, the transfer film and the card are therefore aligned in the stage in which the change of the position of the transfer film due to the change of the path passage is determined, the transfer roller is subsequently shifted to the actuation position, and it is thus possible to synchronize both correctly to perform thermal transfer action. Accordingly, transfer fluctuations do not occur, and printing accuracy is improved. Further, the film does not undergo damage which is caused by the transfer roller contacting portions except the transfer region of the transfer film for a long time as shown in FIG. 20.

EMBODIMENT OF THE INVENTION

The present invention relates to a printing device that transfers an image to a recording medium through a film-shaped medium, and will be described while showing a printing device that records image information on a card through a transfer film as a suitable Embodiment.

Figure 1:
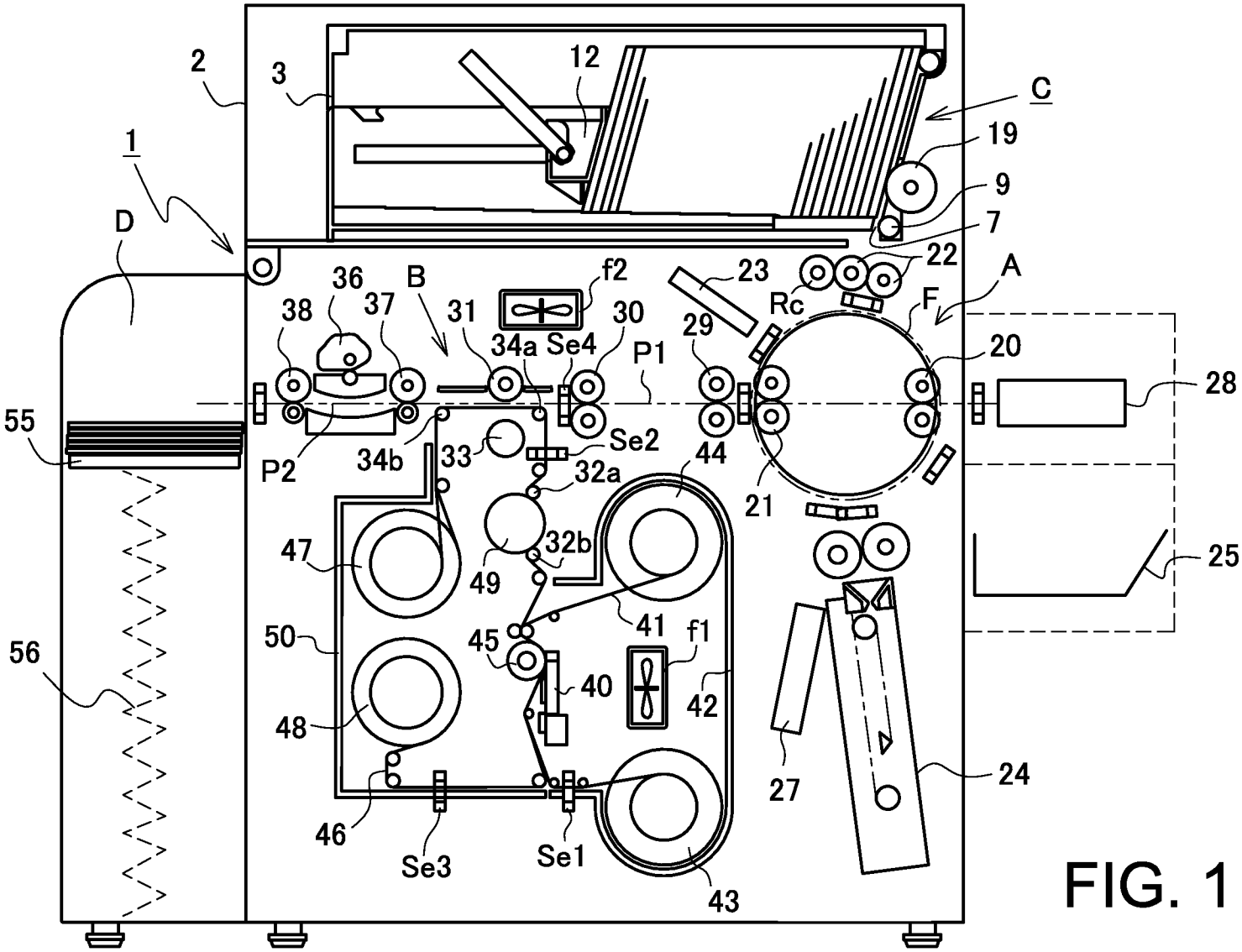
FIG. 1 shows an entire configuration of a printing device according to the invention.

FIG. 1 is an explanatory view of an entire configuration of a printing device according to the invention. This device is to transfer and print image information onto IC cards for various kinds of identification, credit cards for transactions and the like through a transfer film. Therefore, the device is provided with an information recording section A, an image recording section (image formation section; the same in the following description) B, and a card supply section C that supplies cards to the sections.

[Card Supply Section]

A device housing 1 is provided with the card supply section C, and the section C is comprised of a card cassette that stores a plurality of cards. A card cassette 3 as shown in FIG. 1 aligns and stores a plurality of cards in a standing posture, and cards are fed from the left end to the right end as viewed in the figure. Then, a separation opening 7 is provided at the front end of the card cassette 3, and cards are supplied into the device by a pickup roller 19 starting with the card in the front row.

[Configuration of the Information Recording Section]

The card (recording medium; the same in the following description) fed from the card cassette 3 is fed to a reverse unit F from carry-in rollers 22. The reverse unit F is comprised of a unit frame bearing-supported by a device frame (not shown) to be turnable, and a pair or a plurality of pairs of rollers supported on the frame.

In the device as shown in the figure, two roller pairs 20, 21 disposed at a distance at the front and back are axially supported by the unit frame to be rotatable. Then, the unit frame turns in a predetermined-angle direction by a turn motor (pulse motor or the like), and the roller pairs attached to the frame are configured to rotate in the forward and backward directions by a transport motor. This driving mechanism is not shown, and may be configured so that one pulse motor switches between turning of the unit frame and rotation of the roller pairs with a clutch, or different driving may be configured for turning of the unit frame and rotation of the roller pairs.

Accordingly, cards prepared in the card cassette 3 are separated on a card-by-card basis by the pickup roller 19 and separation roller (idle roller) 9 to be fed to the reverse unit F on the downstream side. Then, the reverse unit F carries the card in the unit by the roller pairs 20, 21, and changes the posture in the predetermined-angle direction with the card nipped by the roller pairs.

Around the reverse unit F in the turn direction are disposed a magnetic recording unit 24, non-contact type IC recording unit 23, contact type IC recording unit 27, and reject stacker 25. In addition, a barcode reader 28 is a unit to read a barcode printed in the image formation section B, described later, for example, to verify (error check). Hereinafter, these recording units are referred to as data recording units.

Then, when the card that is posture-changed in the predetermined-angle direction in the reverse unit F is carried to the recording unit by the roller pairs 20, 21, it is possible to input data to the data magnetically or electrically. Further, when a recording mistake occurs in the data input units, the card is carried out to the reject stacker 25.

The image formation section B is provided on the downstream side of the reverse unit F, a transport path P1 for carrying the card from the card cassette 3 to the image formation section B is provided, and the reverse unit F is disposed in the path P1. Further, in the transport path P1 are disposed transport rollers (that may be belts) 29, 30 that transport the card, and the rollers are coupled to a stepping motor to actualize card correct alignment control. The transport rollers 29, 30 are configured to enable switching between forward rotation and backward rotation, and transport the card from the image formation section B to the reverse unit F in a similar manner for transporting the card from the reverse unit F to the image formation section B.

On the downstream side of the image formation section B is provided a carrying-out path P2 for carrying the card to a storage stacker 55. In the carrying-out path P2 are disposed transport rollers (that may be belts) 37, 38 that transport the card, and the rollers are coupled to a transport motor, not shown.

In addition, a decurl mechanism 36 is disposed in between the transport roller 37 and the transport roller 38, presses the card center portion held between the transport rollers 37, 38, and thereby corrects curl. Therefore, the decurl mechanism 36 is configured to be able to shift to positions in the vertical direction as viewed in FIG. 1 by an up-and-down mechanism (cam or the like), not shown.

[Image Formation Section]

The image formation section B forms images such as a photograph of face and character data on the frontside and backside of the card that is a recording medium for printing. The image formation section B is provided with a platen 31 and heat roller 33, and forms the image on the card with the platen. In the device as shown in the figure, an image is first formed (first transfer) on a transfer film 46 (film-shaped medium for intermediate transfer), and the image on the film is further transferred (second transfer) onto the card with the platen 31. Therefore, the device housing 1 is installed with an ink ribbon cassette 42 and a film unit 50 that is a cassette storing the transfer film.

The ink ribbon cassette 42 as shown in the figure is installed in the device housing 1 to be attachable and detachable with a thermal transfer ink ribbon 41 such as a sublimation ink ribbon and others wound between a feed roll 43 and a wind roll 44. The wind roll 44 is coupled to a transfer film wind motor 74*c* (see FIG. 18). Further, on the device side are disposed a thermal head 40 and an image formation platen 45 with the ink ribbon 41 therebetween.

An IC 74*a* for head control (see FIG. 18) is coupled to the thermal head 40 to thermally control the thermal head 40. The IC 74*a* for head control heats and controls the thermal head 40 according to image data, and thereby forms an image on the transfer film 46, described later, with the ink ribbon 41. By this means, an image information record portion d (see FIGS. 23 and 24) is formed on the transfer film 46, and then, is transferred to the card. Therefore, it is configured that the wind roll 44 rotates in synchronization with thermal control of the thermal head 40 to wind the ink ribbon 41 at a predetermined velocity. A cooling fan f1 is provided to cool the thermal head 40.

Meanwhile, the film unit 50 is also installed in the device housing 1 to be attachable and detachable. On the transfer film 46 loaded in the film unit 50, the image is formed on the film for a period during which the film travels between the platen roller (image formation platen) 45 and the ink ribbon 41. Therefore, the transfer film 46 is wound around the supply spool 47 and the wind spool 48, and the transfer film 46 with the image formed by the image formation platen 45 is carried into between the platen 31 and the heat roller 33, described later.

Figure 21:
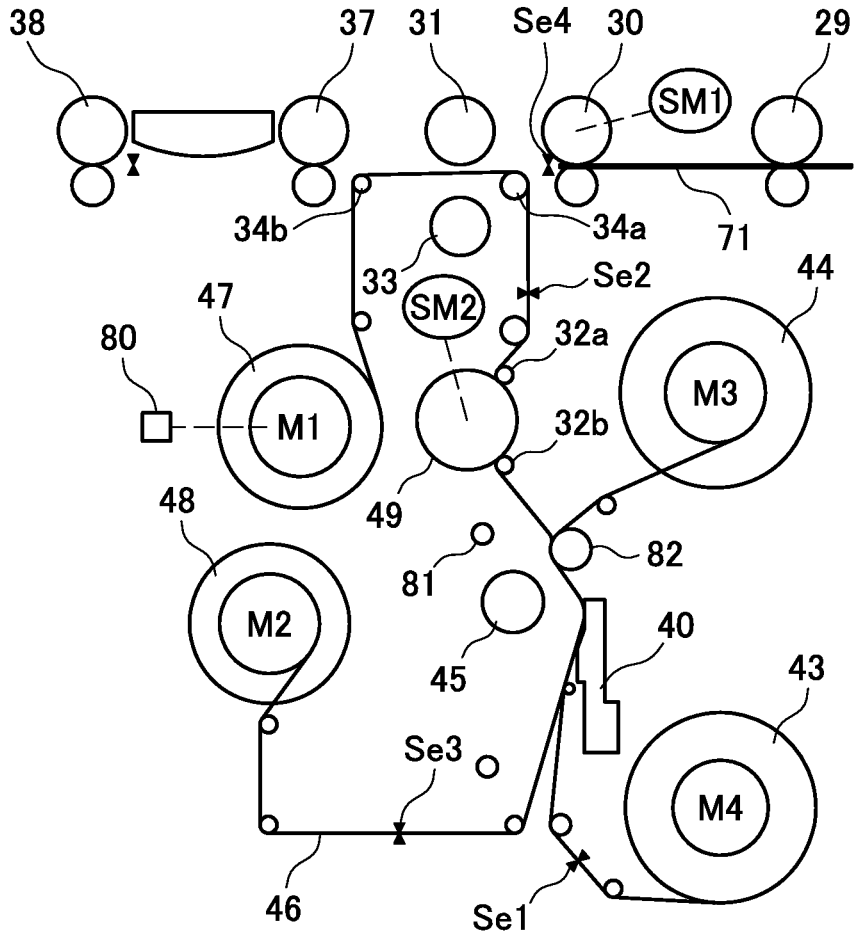
FIG. 21 shows a configuration view of a portion related to image transfer in the device of FIG. 1.

A carry roller 49 is a main transport roller for transporting the transfer film 46 only in image formation (first transfer) onto the transfer film 46, and is coupled to a stepping motor SM2 (see FIG. 21). Then, pinch rollers 32*a* and 32*b* are disposed on the periphery of the carry roller 49, and come into press-contact with the periphery of the carry roller 49 as shown in FIG. 1 in the first transfer state to bring the transfer film 46 into intimate contact with the carry roller 49, and the carry roller 49 performs correct transport action by driving of the stepping motor SM2.

Further, a guide roller 34*a* is to guide the transfer film 46 to the platen 31, and a peeling roller 34*b* is a peeling member that peels off the platen 31 from the card that is the recoding medium. The guide roller 34*a* and peeling roller 34*b* are attached to the film unit 50 with the platen 31 therebetween so that the guide roller 34*a* is on the upstream side and that the peeling roller 34*b* is on the downstream side. Further, the distance L1 between the guide roller 34*a* and the peeling roller 34*b* is set to be shorter than the length Lc (L1<LC) in the image formation direction (transport direction) of the recording medium K (see FIG. 3).

The heat roller 33 that is a transfer roller to thermally transfer the image formed on the transfer film 46 is disposed opposite the platen 31 with the transfer film 46 therebetween. The heat roller 33 heats and comes into press-contact with the image on the image information record portion formed on the transfer film 46 to transfer (second transfer). Then, the heat roller 33 is configured to come into press-contact and separate with/from the platen 31 from the inside of the film unit 50 by transfer roller up-and-down means 61, described later. In addition, a sensor Se1 is to detect the position of the ink ribbon 41, and a sensor Set is to detect the presence or absence of the transfer film 46. Then, the image formation section B is provided with a fan f2 to remove heat generated inside the device to the outside.

[Configuration of the Film Unit]

Figure 2:
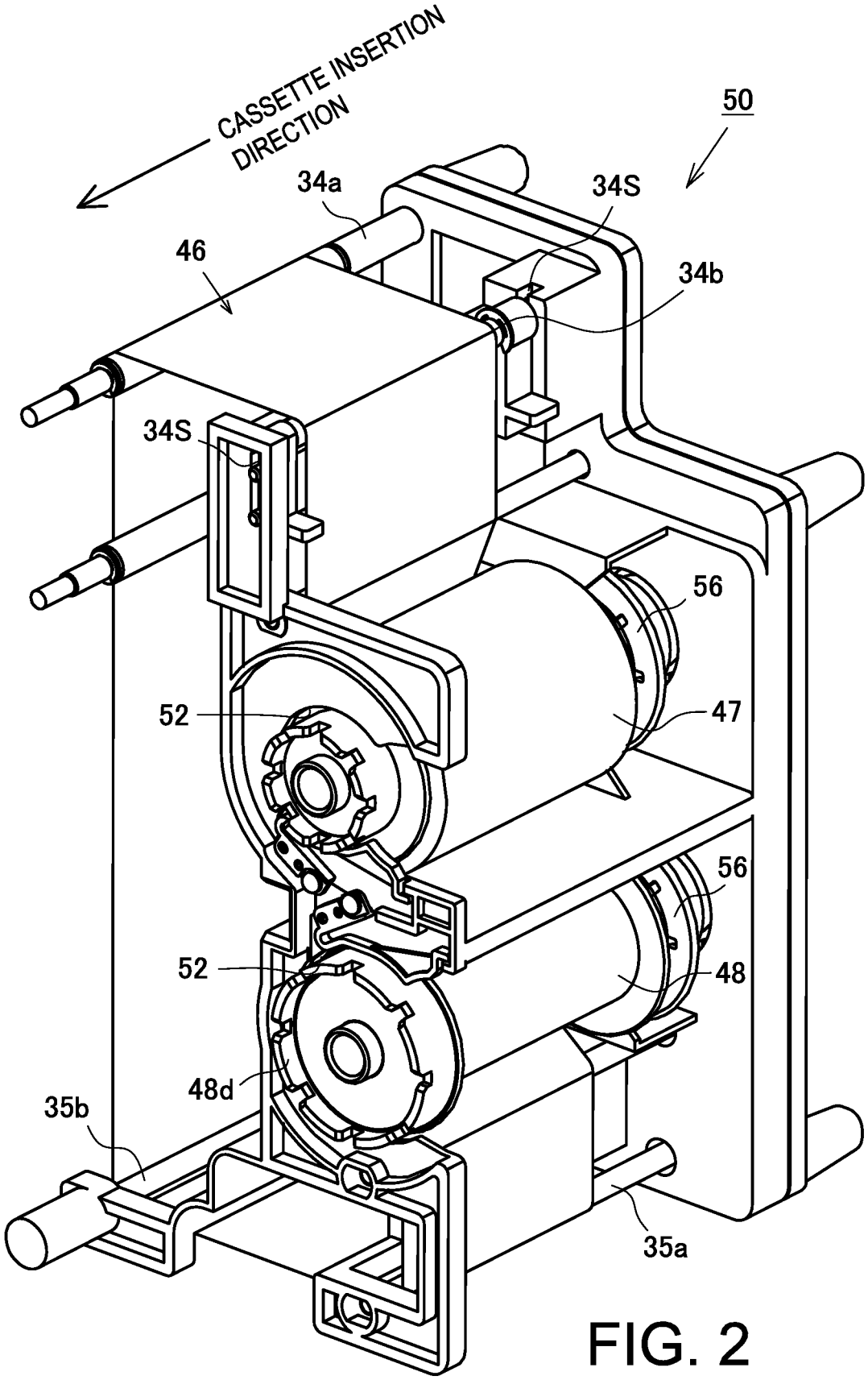
FIG. 2 shows a perspective view of a film unit in the device of FIG. 1.

Described is the film unit 50 loaded with the transfer film 46. As shown in FIG. 2, the film unit 50 is made of a unit separated from the device housing 1, and is attached to the device housing 1 to be attachable and detachable. Not shown in the figure, but a front cover is disposed to be openable and closable on the front side in FIG. 1, and the film unit 50 is inserted in the device frame in the arrow direction in FIG. 2 with the front cover opened.

The film unit 50 is installed with the supply spool 47 and the wind spool 48 to be attachable and detachable. Each of bearing portions 52 supports one end of the spool, and each of coupling members 56 supports the other end of the spool. Then, the transfer film 46 is laid from the supply spool 47 to the wind spool 48 through the peeling roller 34*b*, and guide rollers 34*a*, 35*a*, 35*b*.

The peeling roller 34*b*, and guide rollers 34*a*, 35*a*, 35*b*, which are guide members of the transfer film 46, are formed from pin members (driven rollers) attached to the film unit 50, and the guide members may be fixed pins (non-rotation). In the device, in transferring the image on the transfer film 46 to the card, transfer is performed while winding the transfer film 46 by the supply spool 47. Accordingly, the peeling roller 34*b* is provided on the downstream side (on the side closer to the supply spool 47 than the heat roller 33) in the film transport direction in transfer of the transfer film 46.

In thus laid transfer film 46 are engaged the carry roller 49 and pinch rollers 32*a*, 32*b* disposed on the device side. Then, drive rotating shafts (not shown) coupled to the supply spool 47 and wind spool 48, and the carry roller 49 are driven and rotated to cause the film to travel at the same velocity. Accordingly, in the film unit 50, the carry roller 49 and pinch rollers 32*a*, 32*b* constitute the film transport means for transporting the transfer film 46 to the image formation section B.

[Thermal Transfer Action onto the Card]

Figure 3:
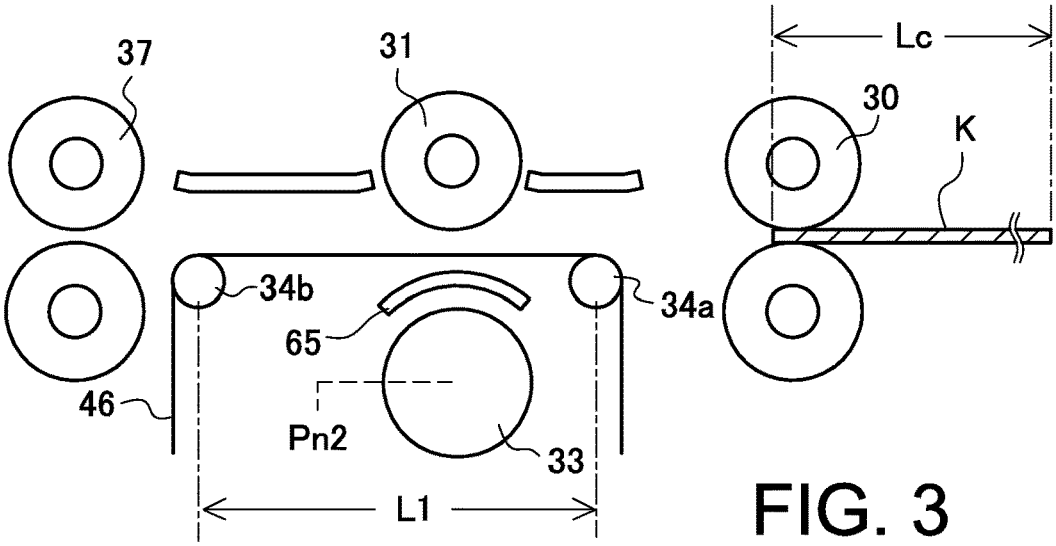
FIG. 3 shows an explanatory view of a state in which a recording medium is carried in in image transfer.
Figure 4:
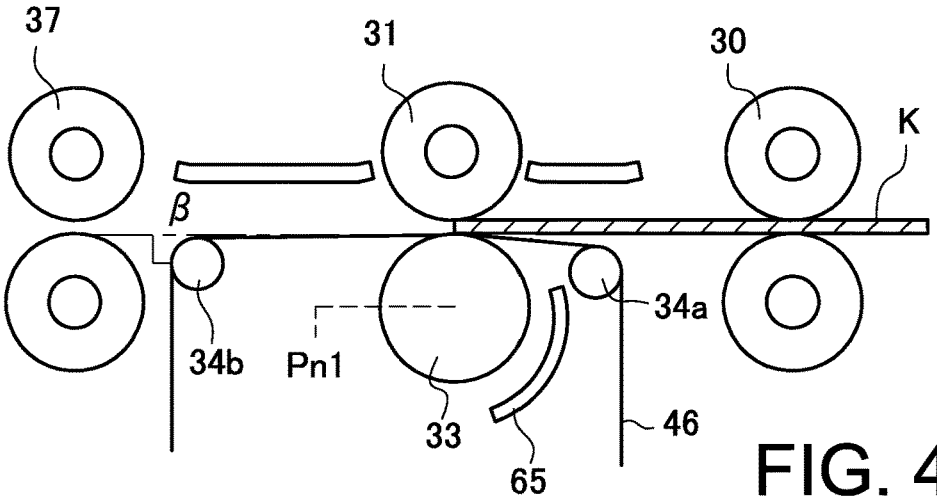
FIG. 4 shows an explanatory view of a state in which a heat roller is in an actuation position in image transfer.
Figure 5:
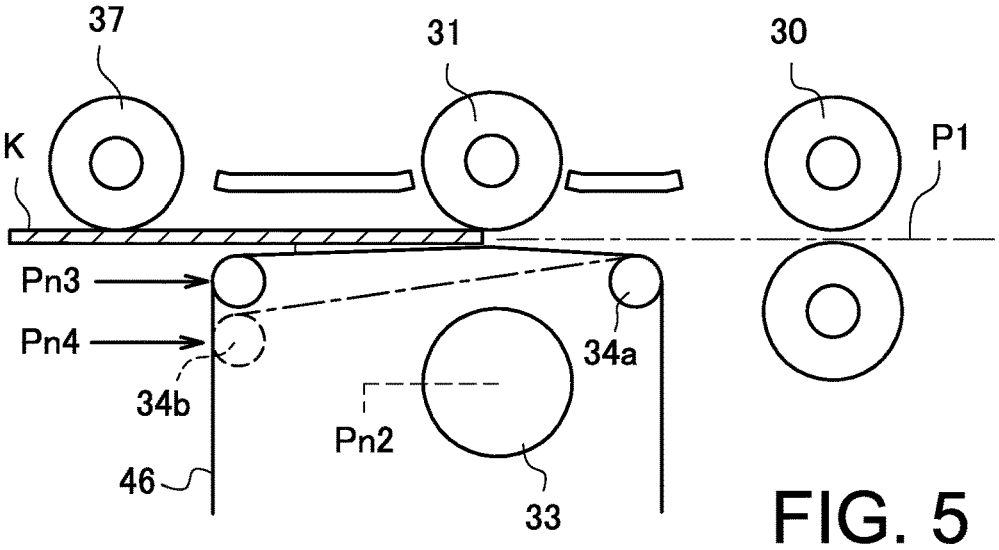
FIG. 5 shows an explanatory view of a state in which the heat roller is in a retracted position in image transfer.

Configurations of sections related to thermal transfer action in the image formation section and film unit will be descried with reference FIGS. 3 to 5. The transfer film 46 is supported by the guide roller 34*a*, and the peeling roller 34*b* as the peeling member. The peeling roller 34*b* is to peel off the film from the card after transferring the image formed on the transfer film 46 to the card.

As shown in FIG. 5, the peeling roller 34*b* is able to shift between an actuation position (solid line) and a retracted position (dashed line), and in the actuation position, is set to contact the surface of the card transported along the transport path P1 via the transfer film 46.

Accordingly, the transfer film 46 transferred to the card adheres to the card from the heat roller 33 to the peeling roller 34*b*, and is peeled off from the card surface when the card reaches the peeling roller 34*b*. At this point, the peeled transfer film 46 is wound in the direction (downward direction as viewed in the figure) orthogonal to the card, and therefore, the relationship of approximately 90 degrees is kept between the card and the peeled transfer film 46 via the peeling roller 34*b* (the peeling angle β is approximately 90 degrees).

Figure 19:
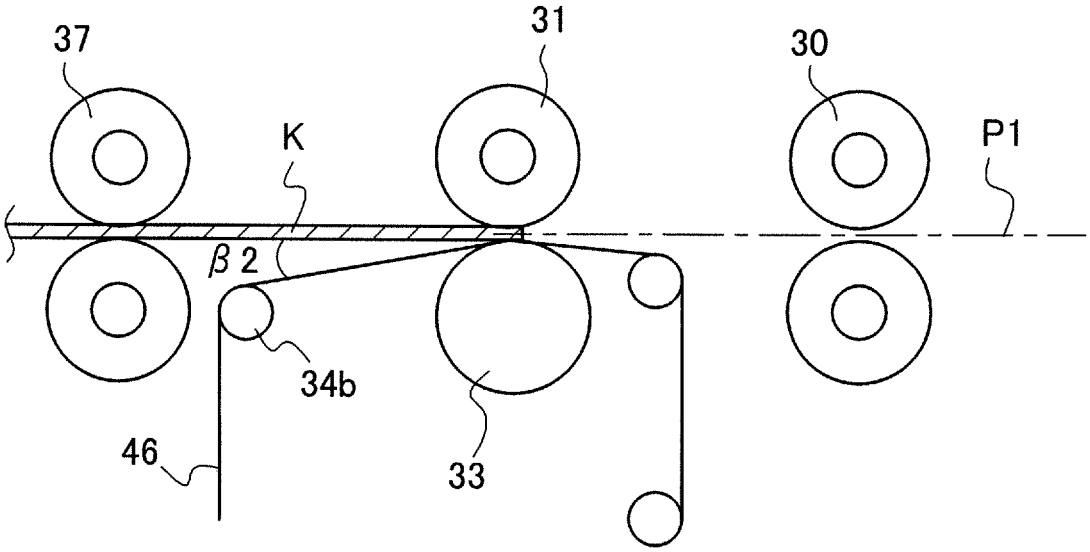
FIG. 19 shows an action explanatory view of conventional peeling action.
Figure 20:
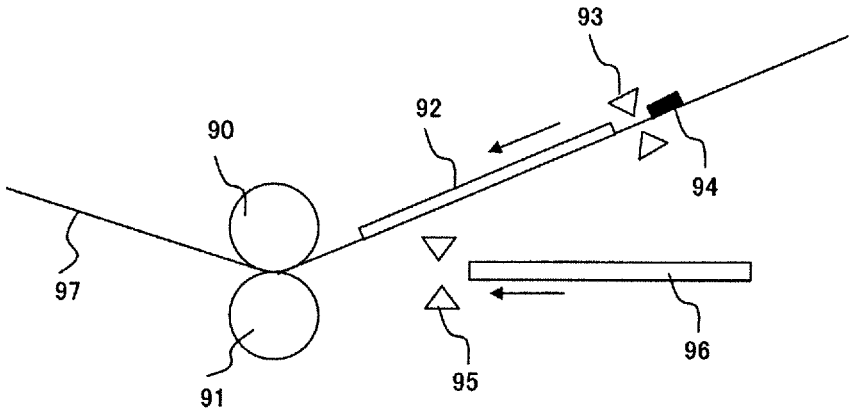
FIG. 20 shows an explanatory view of conventional image transfer.

For example, as shown in FIG. 19, when the peeling roller 34*b* is provided in the position away from the transport path P1, the transferred film 46 peels off from the card before reaching the peeling roller 34*b*. In such a configuration, the position in which the transfer film 46 peels off from the card and the peeling angle (β2) are uncertain, and there is the risk of occurrence of transfer unevenness. Further, since the time between transfer and peeling becomes short, there is a case that good peeling is not performed. Accordingly, by setting the peeling roller 34*b* in the actuation position of this Embodiment, the peeling angle and the time elapsed before peeling (distance from the heat roller 33 to the peeling position) is certain, and it is thereby possible to suppress the occurrence of transfer unevenness.

Figure 18:
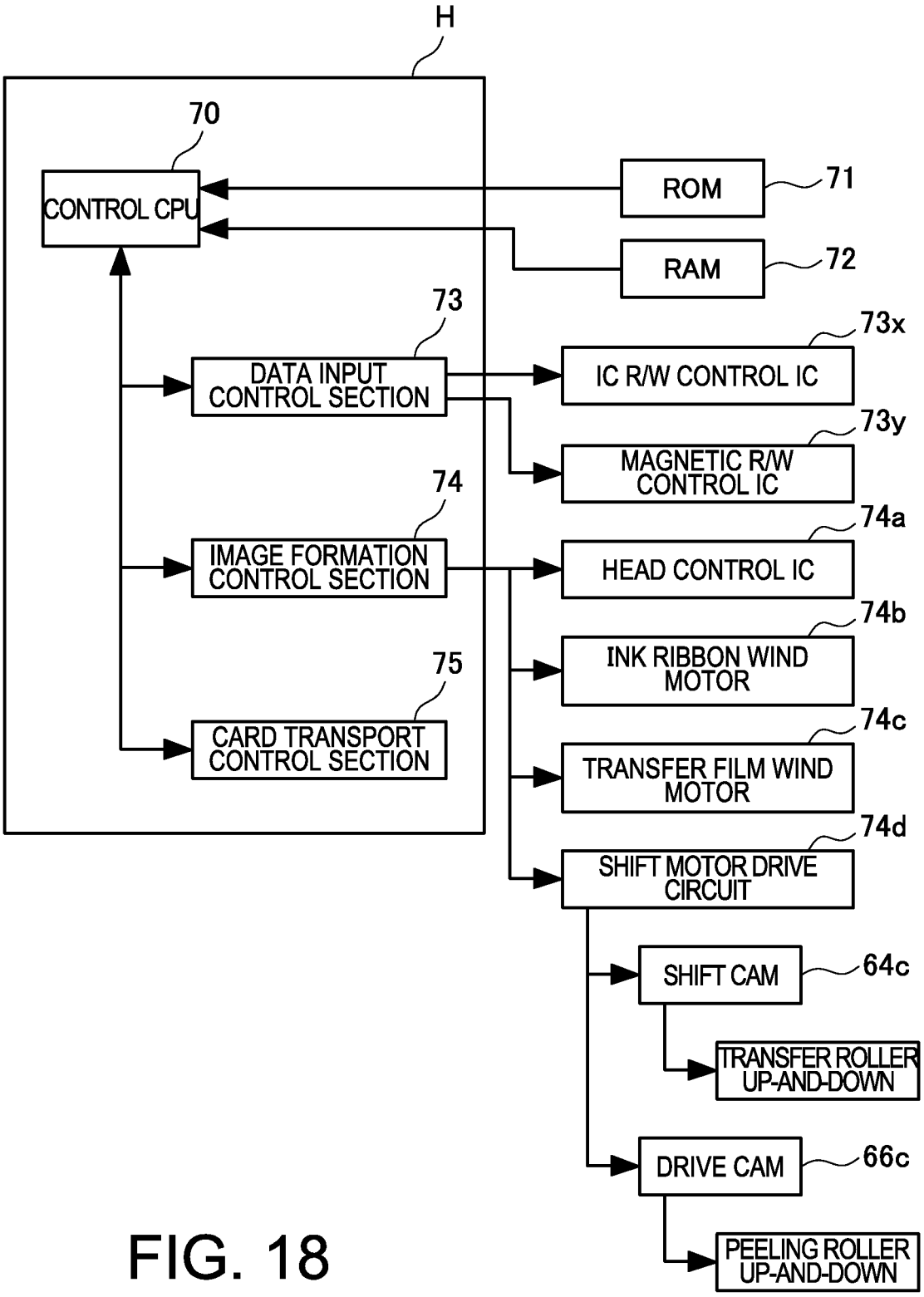
FIG. 18 shows a block diagram of a control configuration of the printing device according to the invention.

Meanwhile, the heat roller 33 comes into press-contact or separates with/from the platen 31, and control means H, described later in FIG. 18, shifts the heat roller 33 to the actuation position (Pn1) to bring into press-contact (FIG. 4) in transferring the image onto the card, and after image formation (after the card rear end passes through the heat roller 33), shifts the roller 33 to the waiting position (Pn2) to separate (FIG. 5). By this means, the transfer film 46 is prevented from contacting the heat roller 33 after the card rear end passes through the heat roller 33, and becoming deformed.

Further, the control means H shifts the peeling roller 34*b* from the actuation position (Pn3) to the waiting position (Pn4) at timing at which the card rear end passes through the peeling roller 34*b*. Herein, since the peeling roller 34*b* is shifted to the waiting position, the card is prevented from colliding with the peeling roller 34*b* in switchback-transporting the card toward the reverse unit F on the upstream side in the transport path in performing two-side printing. Such control eliminates the risk that the transfer film 46 is acted upon by excessive heat and becomes deformed, and also the occurrence of image unevenness in peeling the transfer film 46.

The present invention is to thus correctly control timing for moving up and down the heat roller 33 and peeling roller 34*b*, and thereby actualize transfer to the card by the transfer film with high accuracy without causing transfer fluctuations, and the action will be clarified later.

[Up and Down of the Heat Roller and the Peeling Roller]

Figure 6:
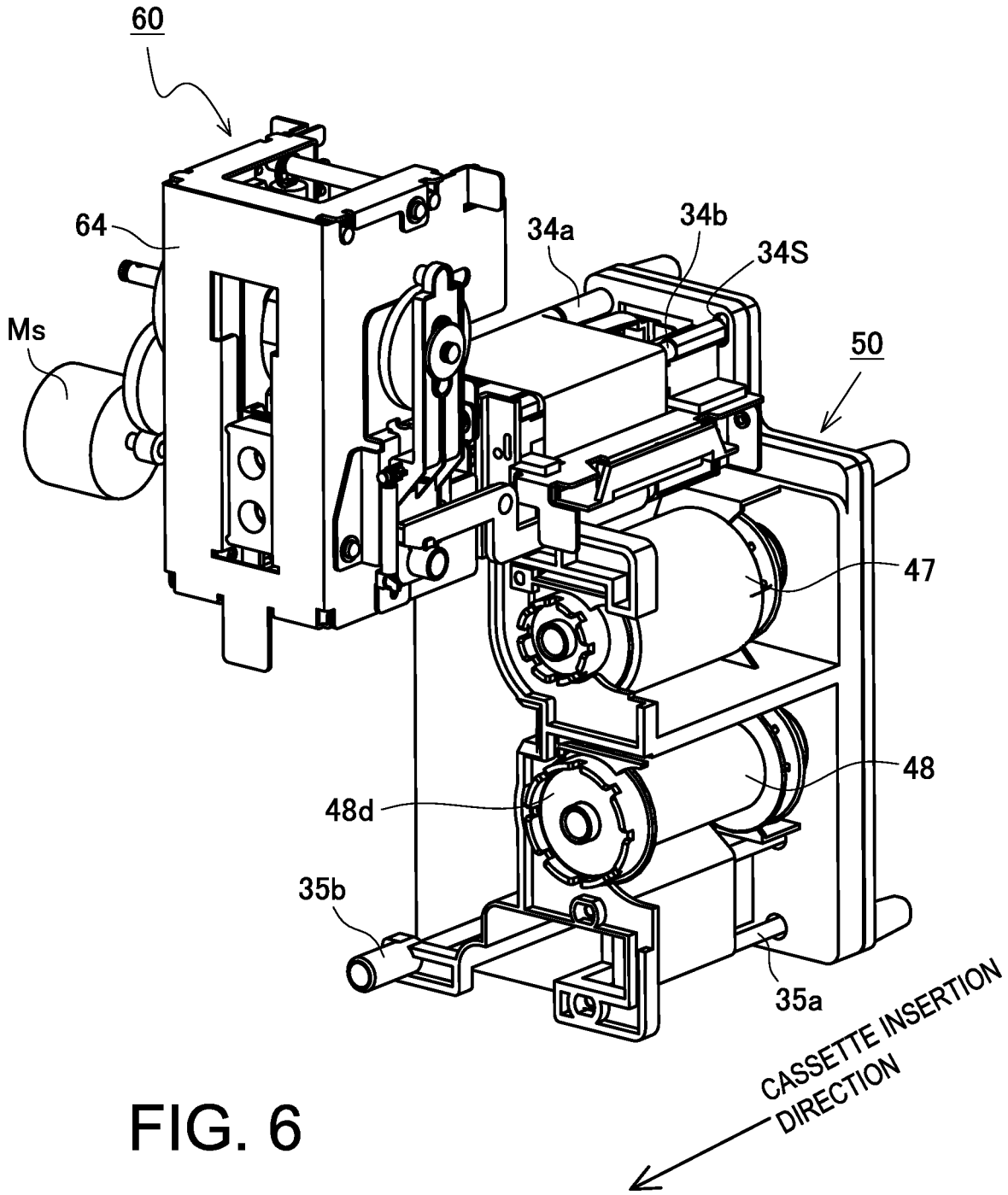
FIG. 6 shows a perspective configuration view of a transfer unit and a film unit in the device of FIG. 1.

Transfer roller up-and-down means 61 and peeling member up-and-down means 62 are provided to move the heat roller 33 and the peeling roller 34*b* up and down, respectively. FIG. 6 is an explanatory view showing the entire configuration of the film unit 50 as described previously, transfer roller up-and-down means 61 and peeling member up-and-down means 62. These up-and-down means 61, 62 and heat roller 33 are built in a film unit 60, and are attached to the device frame. Meanwhile, the peeling roller 34*b* is attached to the film unit 50 side.

Figure 7:
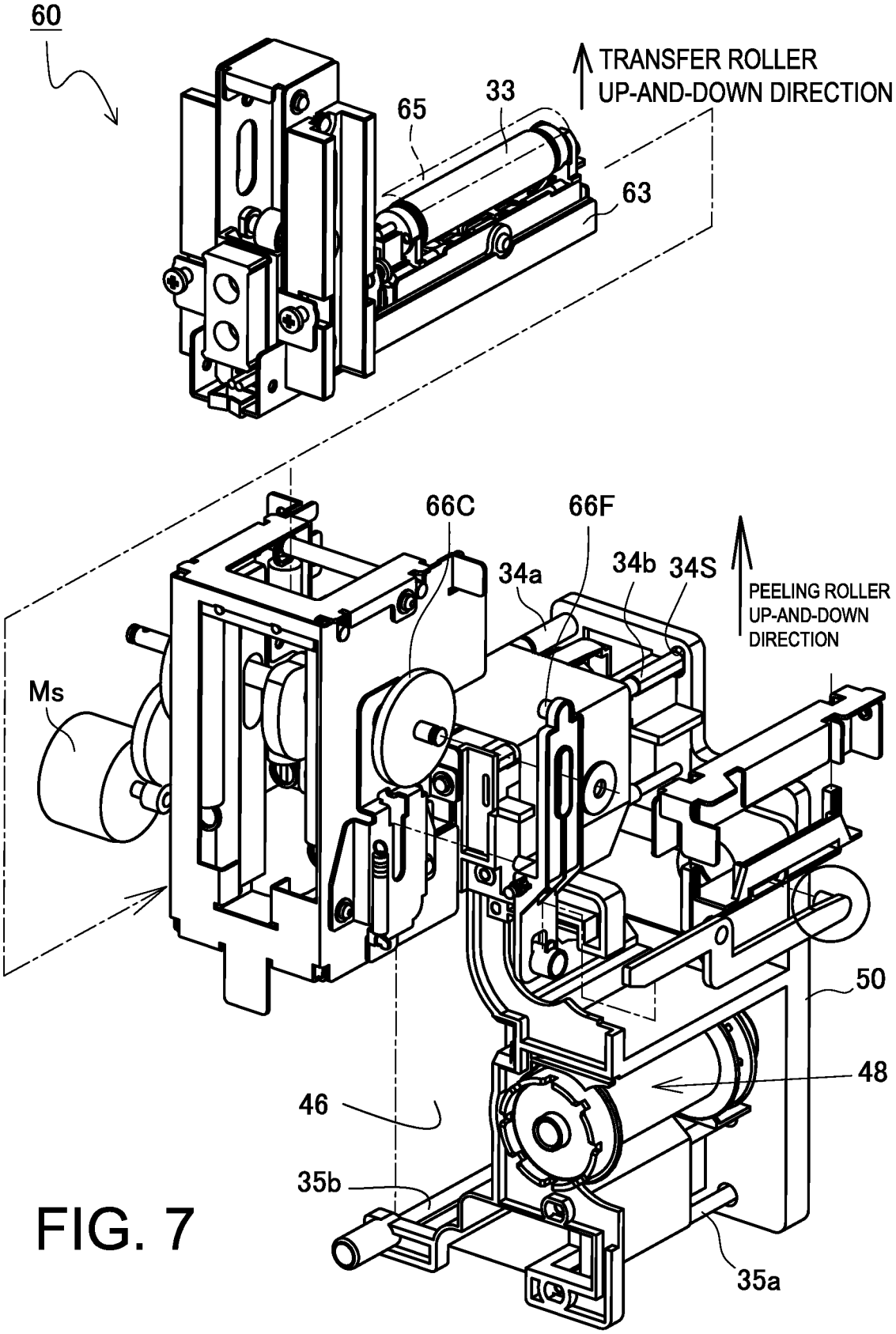
FIG. 7 shows an assembly exploded view of the transfer unit in the device of FIG. 6.

In FIG. 6, the film unit 50 is inserted in the device frame in the arrow direction to be attachable and detachable. Then, the film unit 60 provided in the device frame is combined with the transfer film 46 of the film unit 50. FIG. 7 is an assembly exploded view of the film unit 60, and in the transfer unit 60, an up-and-down frame 63 (first shift member) provided with the heat roller 33 is supported to be able to move up and down in the arrow direction shown in the figure. Further, the peeling roller 34*b* is supported by a fit groove 34S on the film unit 50 side to be able to move up and down.

Figure 8:
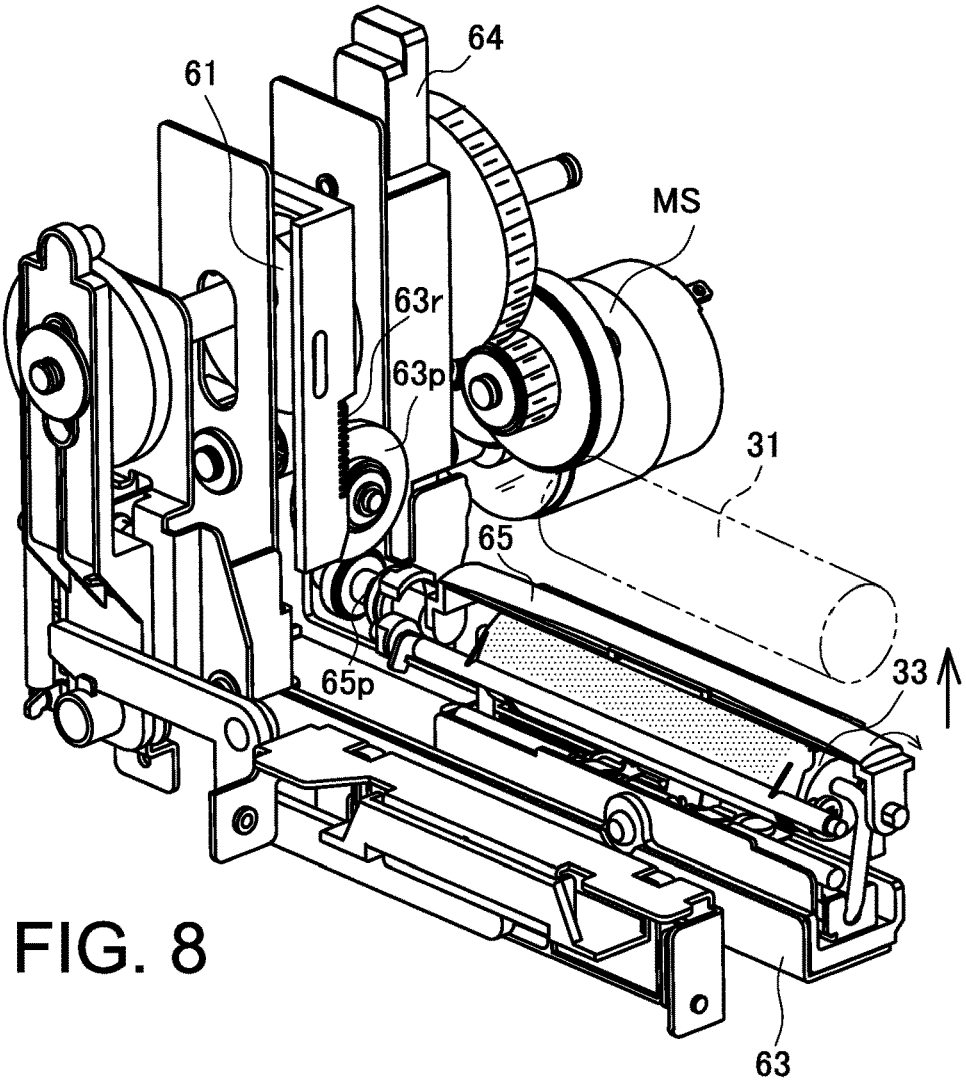
FIG. 8 shows an entire perspective view of an up-and-down mechanism of the heat roller.

FIG. 7 shows a configuration of the up-and-down frame 63 provided with the heat roller 33. The heat roller 33 is attached, in the position opposed to the platen (roller, in the FIG. 31, to a unit frame 64 to move up and down in the arrow direction shown in FIG. 7 together with the up-and-down frame 63. Then, a shift motor MS is attached to the unit frame 64, and the rotating shaft of the motor is provided with a shift cam 64*c* (for example, eccentric cam). By rotation of the shift cam 64*c*, the up-and-down frame 63 fitted with the cam in a long groove (cam follower; not shown) moves up and down in the vertical direction in FIG. 8.

Further, the heat roller 33 is provided with an open/close cover 65 in the position opposed to the platen 31 to rotate (open and close) on the spindle 65*p* in the arrow direction shown in the figure. The open/close cover 65 prevents a user from touching the heat roller 33 of high heat by the finger. Therefore, when the heat roller 33 is in the waiting position (Pn2; FIG. 3), the open/close cover 65 covers the roller surface, and when the card causes a jam and the user performs jam clearing operation, guards against touching the roller surface. When the heat roller 33 is in the actuation position (Pn1; FIG. 4), the cover 65 retracts from the roller surface, and the transfer film 46 comes into press-contact with the platen 31. Further, by covering the heat roller 33, since heat is not applied to the transfer film 46 except the transfer time, covering also protects the transfer film 46.

For the open/close mechanism, the unit frame 64 is integrally provided with a rack 63*r*, and the up-and-down frame 63 is provided with a pinion 63*p* meshing with the rack. The pinion 63*p* is gear-coupled to the spindle 65*p* of the open/close cover 65. Accordingly, when the shift cam 64*c* is rotated by the shift motor MS to move the up-and-down frame 64 up in the arrow direction in FIG. 8, the pinion 63*p* rotates in a counterclockwise direction in FIG. 8, and the open/close cover 65 gear-coupled to the pinion 63*p* rotates in the arrow (clockwise direction) direction shown in the figure.

Thus, the transfer roller up-and-down means 61, which moves the heat roller 33 up and down between the actuation position (Pn1) in press-contact with the card and the separated retracted position (Pn2), is comprised of the shift motor MS and the shift cam 64*c*. Further, the transfer roller up-and-down means 61 opens and closes the open/close cover 65 of the heat roller 33 between an open position shown in FIG. 4 and a close position shown in FIG. 3.

Described next is the peeling member up-and-down means 62 for moving the peeling roller 34*b* up and down between the actuation position (Pn3) for peeling off the transfer film of which the image is transferred to the card and the retracted position (Pn4) separated from the recording medium K.

Figure 9:
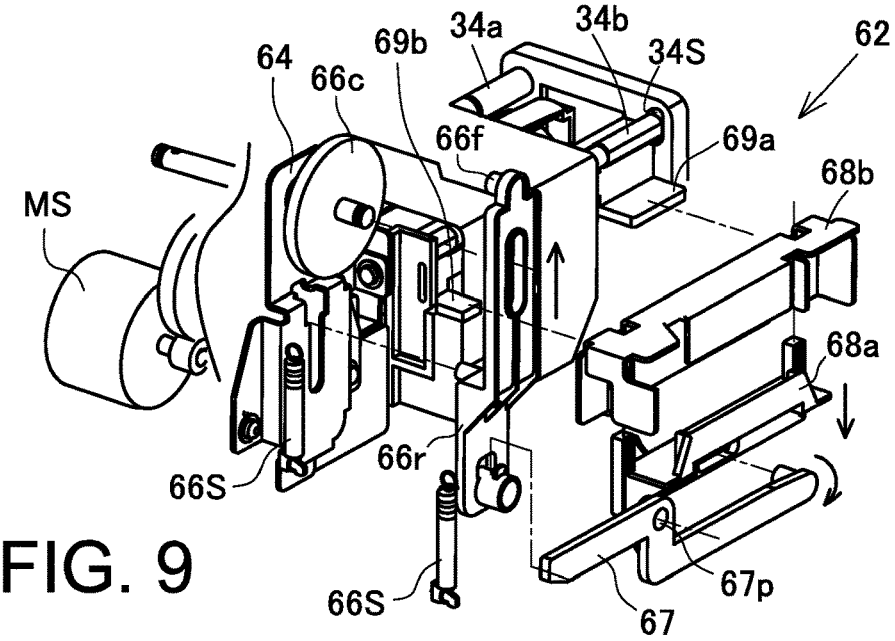
FIG. 9 shows a configuration view of an up-and-down mechanism of a peeling roller in FIG. 8.

FIG. 9 is an explanatory view of only a configuration of the peeling member up-and-down means 62 extracted from the mechanism of FIG. 7. As shown in FIG. 9, a drive cam 66*c* is coupled to the drive rotating shaft 64*d* gear-coupled to the shift motor MS. A lever 66*r* (second shift member) provided with a cam follower 66*f* engaging in the drive cam 66*c* is supported movably up and down by the unit frame 64 with a slit and a pin to move up and down in the vertical direction in FIG. 9. A release spring 66S is laid between the lever 66*r* and the unit frame 64.

Accordingly, when the drive cam 66*c* rotates by rotation of the shift motor MS, the lever 66*r* having the cam follower 66*f* moves up and down. In addition, as described later, the drive cam 66*c* causes the peeling roller 34*b* to wait in the retracted position (Pn4), and shifts the roller 34*b* from this state to the actuation position (Pn3) by angle control of the shift motor MS.

Then, the lever 66*r* is raised in the arrow direction by rotating the drive cam 66*c*. The lever 66*r* is coupled to a swing lever 67, and the swing lever 67 rotates (swings) on the spindle 67*p* in the arrow direction in FIG. 9. Then, an up-and-down lever 68*a* pin-slit-coupled to the swing lever 67 moves downward in the arrow direction. An actuation lever 68*b* integral with the up-and-down lever 68*a* engages in peeling pin brackets 69*a*, 69*b*. In addition, the up-and-down lever 68*a* is restricted in motion in the vertical-motion direction in the unit frame 64 by pin-slit coupling.

Accordingly, the swing lever 67 swings by up-and-down motion of the lever 66*r* which moves upward by the drive cam 66*c* and moves downward by the release spring 66S, the up-and-down lever 68*a* and the actuation lever 68*b* move up and down, and the peeling pin brackets 69*a*, 69*b* engaging in the actuation lever 68*b* move up and down. The peeling pin brackets 69*a*, 69*b* are integrally attached to opposite end portions of the peeling roller 34*b*.

Thus, the peeling member up-and-down means 62 is comprised of the shift motor MS, drive cam 66*c*, lever 66*r*, swing lever 67, up-and-down lever 68*a*, and actuation lever 68*b*. The device shown in the figure moves the opposite ends of the peeling member (peeling roller) 34*b* up and down equally by the same amount without leaning by the actuation lever 68*b*.

As can be clarified from the above-mentioned description, the cam shapes of the shift cam 64*c* of the transfer roller up-and-down means 61 and the drive cam 66*c* of the peeling member up-and-down means 62 are set so that the heat roller 33 and the peeling roller 34*b* move up and down at timing described in FIGS. 6 to 9 by driving of the drive rotating shaft 64*d*.

[Control Configuration]

A control configuration will be described in FIG. 18. The control means H is comprised of a control CPU 70, and a data input control section 73, image formation control section 74 and card transport control section 75 each controlled by the control CPU. Then, the control CPU 70 is provided with ROM 71 and RAM 72.

The card transport control section 75 transmits command signals to a drive circuit of the drive motor, not shown, so as to control recording medium transport means (transport roller pairs shown in FIG. 1) disposed in the transport path P1 and the transport path P2. The card transport control section 75 transmits command signals to a drive circuit of the turn motor of the reverse unit F. Concurrently therewith, the card transport control section 75 is connected to receive job signals from the data input control section 73, and is configured to monitor a transport state of a card based on a detection signal from each card detection sensor disposed inside the device when a job signal is input.

The data input control section 73 is configured to transmit command signals to control transmission and reception of input data to an IC 73*y* for magnetic R/W control built in the magnetic recording unit 24, and similarly transmit command signals to the non-contact type IC recording unit 23 and an IC 73*x* for contact type IC R/W control. The image formation control section 74 controls image formation on the frontside and backside of the card in the image formation section B.

The image formation control section 74 transfers an image to the surface of a card with the platen 31 and the heat roller 33 corresponding to transport of the card controlled in the card transport control section 75. Therefore, the image formation control section 74 is provided with a head controller IC 74*a* for controlling the thermal head 40 to form an image on the transfer film 46 in first transfer, an ink ribbon wind motor control section 74*b*, a transfer film wind motor control section 74*c*, and a shift motor drive circuit 74*d*.

Then, the RAM 72 stores processing time for the data input section (magnetic/IC recording section) to input data on the card, for example, in a data table.

Described is action for thermally transferring from the transfer film to the card in the printing device according to this Embodiment of the invention with the above-mentioned configuration.

Figure 10:
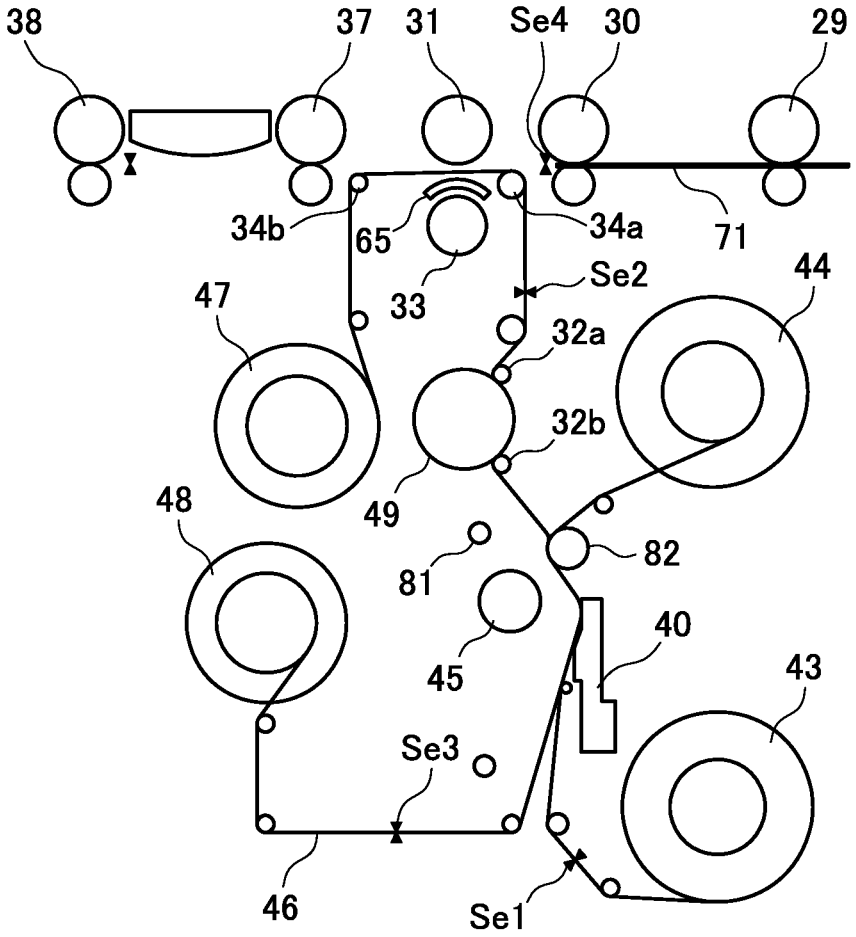
FIG. 10 shows a configuration view of a portion related to image transfer in the device of FIG. 1.

FIG. 10 shows a state in which first transfer for forming an image on the transfer film 46 with the ink ribbon 41 is finished. In FIG. 10, transport rollers 29, 30 are transport means (medium transport means) of the card that is a recording medium to print by the transfer film, and further, the film unit 50 comprised of the supply spool 47, wind spool 48, peeling roller 34*b* with the transfer film 46 laid between the supply spool 47 and the wind spool 48, guide rollers 34*a*, 35*b*, 35*a* and the like is the film transport means for transporting the transfer film 46 to the image formation section B as descried previously.

Then, in the state as shown in FIG. 10, near the transfer position in which the heat roller 33 and platen 31 exist, since the peeling roller 34*b* is in the retracted position, the film path formed from the film transport means is the same in the transport direction as the medium transport path (transport path P1) formed from the card transport means, but does not contact the medium transport path. At this point, the beginning mark provided in the transfer film 46 waits on the upstream side of the film sensor Set, and a record portion of the image formation to transfer to the card is positioned on the upstream side of the beginning mark. Meanwhile, the card waits on the upstream side of the card sensor Se4.

The transfer action is started from this state, and the thermal transfer action will be described below with reference to FIGS. 11 to 17 showing only the principal part.

When the sensor Se4 detects the approach of the card to form an image to the platen 31 (FIG. 11), the image formation control section 74 of the control CPU 70 controls the shift motor drive circuit 74*d* to rotate the shift motor MS a predetermined angle. Then, by rotation of the drive cam 66*c*, the peeling roller 34*b* shifts to the peeling position and is in the state as shown in FIG. 12.

Figure 12:
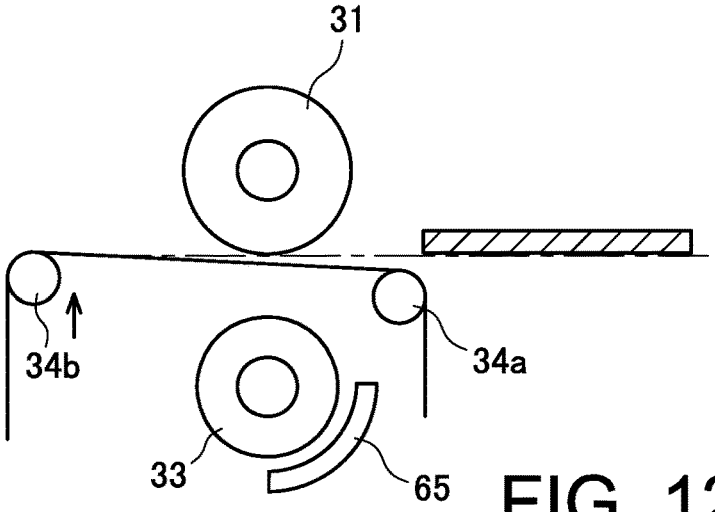
FIG. 12 shows an action explanatory view of a state in which the peeling roller shifts to a peeling position in the printing device according to the invention.

In the state as shown in FIG. 12, the peeling roller 34*b* is shifted from the retracted position to the actuation position for peeling action, and by the shift of the peeling roller 34*b*, since the transfer film 46 also shifts together with the peeling roller 34*b*, the film is drawn from the supply spool 47 or wind spool 48 to change the film path. The film path at this point contacts the recording medium transport path (transport path P1) of the transfer time, and the position of the transfer film is determined.

Figure 13:
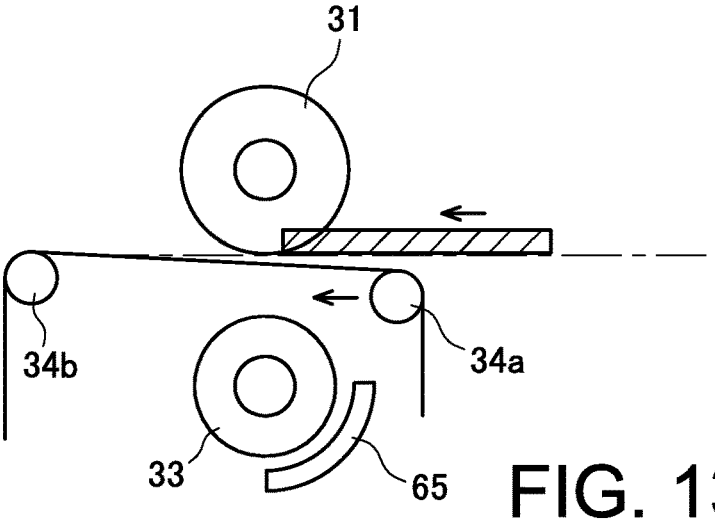
FIG. 13 shows an action explanatory view of a state of alignment in the printing device according to the invention.

Next, the control CPU 70 controls transport of the card by the card transport control section 75, concurrently controls the transfer film wind motor 74*c* by the image formation control section 74, and performs action as alignment processing means for aligning the card and the transfer film 46 as shown in FIG. 13.

First, the transfer film wind motor 74*c* controls the drive motor of the supply spool 47 to transport the transfer film 46 so as to align the image information record portion of the transfer film 46 on the platen 31. In this case, the image formation control section 74 controls the transfer film wind motor 74*c* to halt transport after a lapse of time during which the sensor Set detects the film beginning mark set on the beginning of the image information record portion of the transfer film 46, and the image information record portion reaches the platen 31.

After finishing alignment of the transfer film, the card transport control section 75 controls the motor for driving the transport roller 30, and transports the card to align on the platen 31. Then, the section 75 halts transport after a lapse of time during which the sensor Se4 detects the front end of the card and the card reaches the platen.

In the alignment processing as described above, the transfer film 46 is first transported for alignment and then, the card is transported for alignment. However, both transport may be performed concurrently, or the card may be first while the transfer film 46 may be later. In addition, when the card is first and the transfer film 46 is later, there is the risk that the held image rubs the card and becomes damaged when the image information record portion of the transfer film 46 passes in a state in which the card waits in the transfer position.

Figure 14:
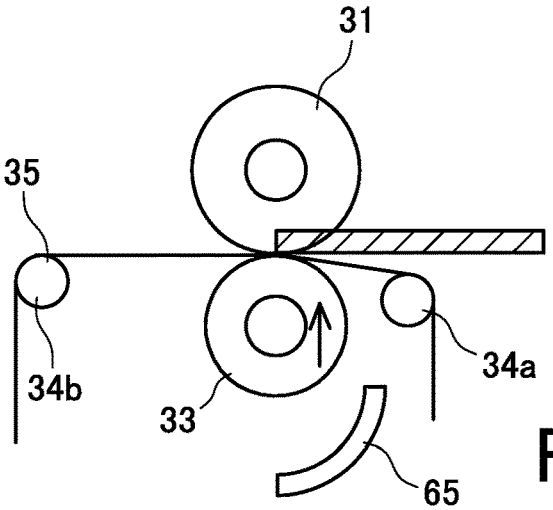
FIG. 14 shows an action explanatory view of a state in which the heat roller shifts to an actuation position in the printing device according to the invention.

Next, the image formation control section 74 of the control CPU 70 further controls the shift motor drive circuit 74*d* to rotate the shift motor MS a predetermined angle, and by rotation of the shift cam 64*c*, the heat roller 33 shifts to the actuation position and becomes the state as shown in FIG. 14. Then, the control CPU 70 controls the transfer film wind motor 74*c* and the card transport control section 75 to concurrently transport the transfer film 46 and the card, the transfer film 46 image formation portion and the card are thereby nipped by the platen 31 and the heat roller 33, the image held in the image information record portion is transferred to the card, and printing is performed.

Thus, when alignment is performed by finding the card and the beginning of the transfer film 46 by the sensors Set and Se4 at the time the position of the transfer film is determined, the card and the transfer film 46 do not become misaligned at the time of transfer.

Figure 15:
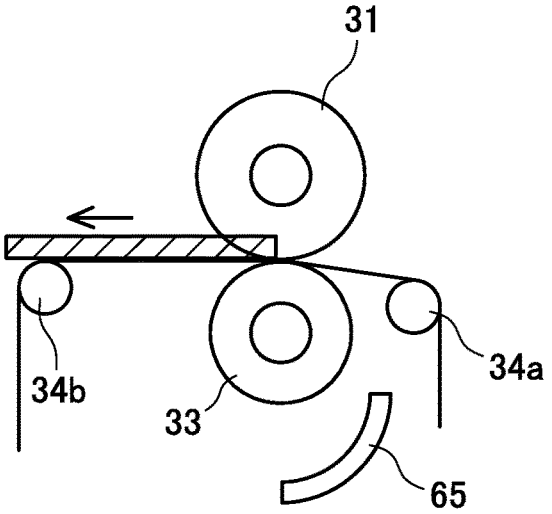
FIG. 15 shows an action explanatory view of a state in which the card rear end passes through the heat roller and transfer is finished in the printing device according to the invention.
Figure 16:
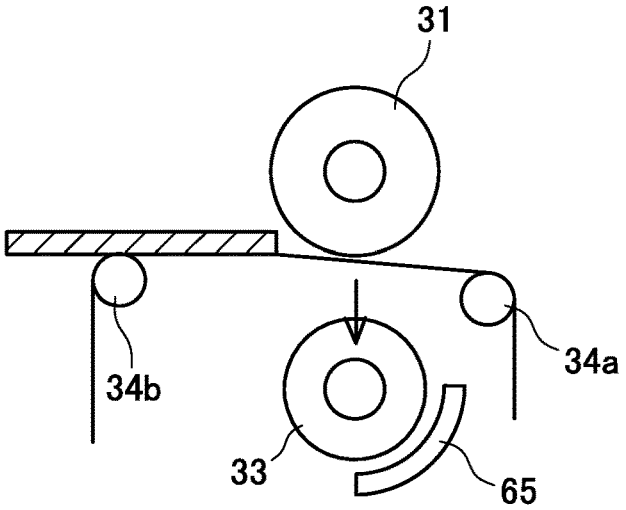
FIG. 16 shows an action explanatory view of a state in which the heat roller returns to a waiting position from the actuation position in the printing device according to the invention.

Then, after a lapse of predicted time (beforehand set timer time) of the state of FIG. 15 in which the card rear end passes through the platen 31 and the heat roller 33, the image formation control section 74 of the control CPU 70 controls the shift motor drive circuit 74*d* to further rotate the shift motor MS a predetermined angle, and by rotation of the shift cam 64*c*, returns the heat roller 33 from the actuation position to the waiting position. This state is shown in FIG. 16, and at this point, the peeling roller 34*b* is held in the actuation state for peeling the transfer film 46 from the card.

Figure 17:
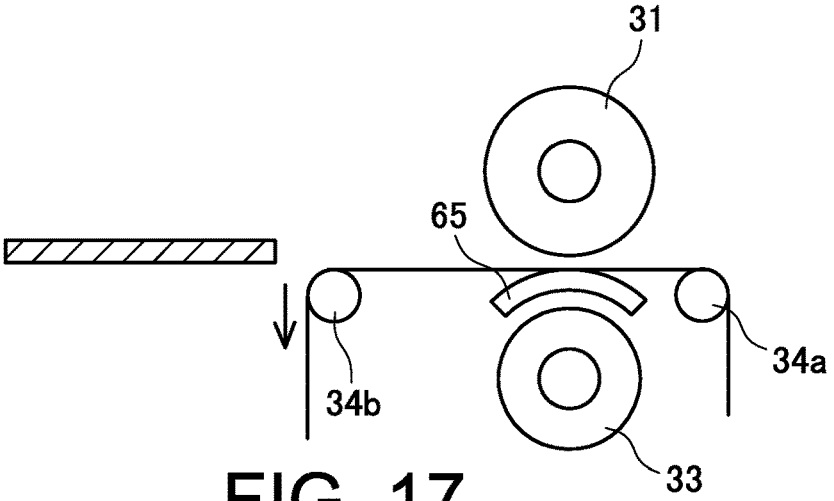
FIG. 17 shows an action explanatory view of a state in which the peeling roller shifts from a peeling position to a retracted position in the printing device according to the invention.

Thereafter, after the end of the predicted time (timer time) the card rear end passes through the peeling roller 34*b*, the control CPU 70 rotates again the shift motor MS a predetermined angle, and by rotation of the drive cam 66*c*, shifts the peeling roller 34*b* from the peeling position to the retracted position. This state is shown in FIG. 17, and the film path comes off the medium transport path (transport path P1). At this point, the heat roller 33 is held in the waiting position. By finish of such a series of action, the shift cam 64*c* and the drive cam 66*c* return to home position.

As described above, the peeling roller 34*b* is shifted to the actuation position earlier than the heat roller 33, alignment is thereby performed after determining the position of the transfer film 46, and it is thus possible to perform printing with high accuracy without causing transfer unevenness.

Further, after transfer, the heat roller 33 is retracted to the waiting position before the peeling roller 34*b* performs peeling action, and the transfer film 46 is thus prevented from contacting the heat roller 33 after the card rear end passes through the heat roller 33, and becoming deformed.

In addition, in the alignment processing of the card and the transfer film 46 as described above, shown is the aspect in which alignment of the transfer film 46 is first performed, and then, the card alignment is performed. Further, when alignment of the transfer film 46 and the card is performed in the following configuration, alignment accuracy is further improved, and details thereof will be described.

As shown in FIG. 21, the supply spool 47 and the wind spool 48 are respectively coupled to output shafts of DC motors M1, M2, the DC motor M1 is driven in transposing the transfer film 46 to the transfer position, and the DC motor M2 is driven in winding the transfer film 46.

The winding action of the transfer film 46 is performed in backward motion when the transfer film 46 shifts and reciprocates on the surface of the thermal head 40, corresponding to component colors when the image is a color image in forming the image (first transfer) with the ink ribbon 41.

Further, the feed roller 43 and wind roller 44 of the thermal transfer ink ribbon 41 in the ink ribbon cassette 42 are also coupled to output shafts of DC motors M3 and M4.

Figure 22:
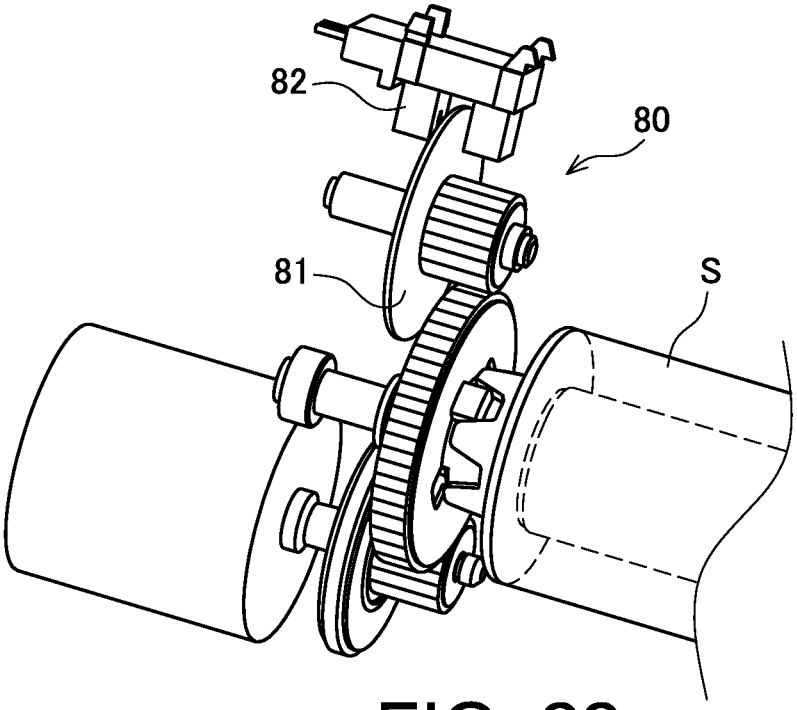
FIG. 22 shows a configuration explanatory view of an encoder.

A transport amount of the transfer film 46 transported by the supply spool 47 and the wind spool 48 is detected by an encoder 80 that rotates in synchronization with the DC motors M1, M2. As shown in FIG. 22, the encoder 80 is comprised of a rotating plate 81 with a slit provided and an optical sensor 82, and when the rotating plate 81 rotates together with the film spool S (supply spool 47 and wind spool 48) that rotates by driving force of the DC motor M (M1, M2), the sensor 82 is switched between on and off at timing for detecting the slit of the rotating plate 81, and generates a clock signal. For the clock signal, there are two usage modes, a high-density mode for using 1 clock as 1 clock and a division mode for using 32 clocks as 1 clock.

In the high-density mode, the clock signal is used in the film alignment processing for grasping a deviation of the stop position of the transfer film, in transporting the transfer film 46 to the transfer position (second transfer) by the heat roller 33 by rotation of the supply spool 47 by driving of the DC motor M1. However, when the high-density mode is adopted in all control for transporting the transfer film 46, the load of the control CPU is high, the processing capability of the enter device degrades, and therefore, the division mode is usually used to process.

In the film alignment processing as described above, the control section counts clock pulses generated by the encoder 80 after the sensor Se2 detects the beginning portion beforehand set on the transfer film 46, and the processing is thereby to determine whether the image information record portion d (see FIG. 23) that is first transferred by the thermal head 40 reaches the platen 31. In addition, the number of clock pulses to determine whether to reach the platen 31 varies corresponding to an amount of the transfer film 46 that is already wound around the supply spool 47. In other words, as the amount of wound transfer film 46 is larger, the film spool diameter increases, and a transport amount of the transfer film 46 increases. Therefore, corresponding to the film spool diameter at the time, it is necessary to calculate a rotation amount (driving amount of the DC motor M1) of the supply spool 47 such that the sensor Se2 detects the beginning portion and the image information record portion d reaches the platen 31.

The rotation amount (driving amount of the DC motor M1) of the supply spool 47 is calculated from a ratio between the number of steps of the stepping motor SM2 that drives the carry roller 49 which is mainly used in transport of the transfer film 46 in first transfer, and the number of clock pulses from the encoder 80. In other words, in first transfer, when the stepping motor SM2 is driven, since the number of steps is in accordance with the transport distance, the number of clock pulses generated by the encoder 80 during the defined number of steps represents the transport amount of the transfer film 46 corresponding to the film spool diameter at that time.

Accordingly, by calculating the ratio between the number of steps of the stepping motor SM2 and the number of clock pulses from the encoder 80 in first transfer, it is possible to predict the number of clock pulses next generated by the encoder 80 by the time the image information record portion d reaches the platen 31 for second transfer. Since the stepping motor SM2 for driving the carry roller 49 during first transfer is 0.0106 mm/step and is thus high resolution, it is possible to implement the transport amount of the transfer film 46 corresponding to the film spool diameter with high accuracy.

Described next is the processing for aligning the transfer film and the card, and second transfer action subsequent thereto by the control CPU 70 in the printing device according to this Embodiment with the above-mentioned configuration.

Figure 11:
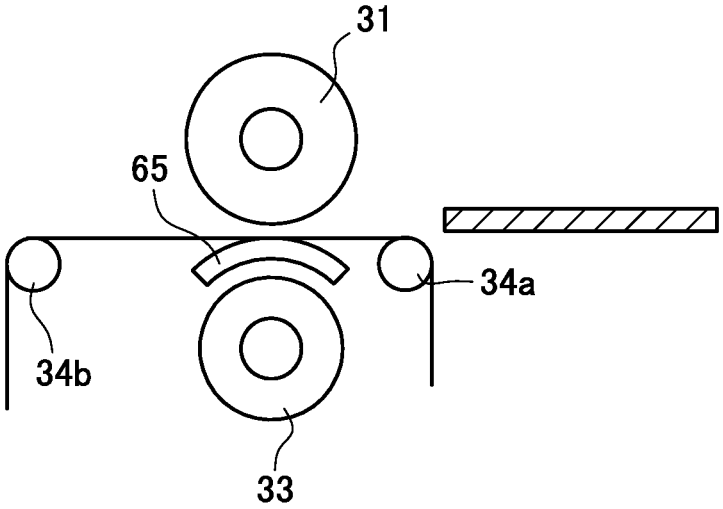
FIG. 11 shows an action explanatory view of a state in which a card approaches in the printing device according to the invention.

Upon detecting that the card to form the image approaches the platen 31 by the sensor Se4, the card transport control section 75 of the control CPU 70 controls the stepping motor SM1 to temporarily halt the card (FIG. 11). Then, the image formation control section 74 of the control CPU 70 controls the shift motor drive circuit 74*d*, and shifts the peeling roller 34*b* to the peeling position to be the state as shown in FIG. 12.

In the state as shown in FIG. 12, the peeling roller 34*b* is shifted from the retracted position to the actuation position for peeling action, the transfer film 46 also shifts together with the peeling roller 34*b* by the shift of the peeling roller 34*b*, the film is thereby drawn from the supply spool 47 or wind spool 48, and the film path changes. The film path at this point contacts the medium transport path (transport path P1) by the medium transport means formed of the transport rollers 29, 30 in transfer, and the position of the transfer film is thereby determined.

Upon determining the position of the transfer film, the control CPU 70 next performs control as the alignment processing means. First, the CPU 70 controls the transfer film wind motor 74*c*, and transports the transfer film 46 to perform the alignment processing of the image information record portion d (see FIG. 23) of the transfer film 46. In this case, the image formation control section 74 detects the film beginning mark (not shown) set on the beginning of the image information record portion d of the transfer film 46 by the sensor Set, then counts clock signals generated from the encoder 80, and when the count value reaches a predetermined value, halts transport of the transfer film 46.

As described already, the transport amount of the transfer film 46 varies with the film spool diameter of the supply spool 47 each time. Accordingly, in the stage of first transfer that is the stage prior to second transfer, the image formation control section 74 calculates the ratio between the number of steps of the stepping motor SM2 and the number of clock pulses from the encoder 80, predicts the number of clock pulses that the encoder 80 generates by the time the image information record portion d of the transfer film 46 reaches the platen 31 based on the ratio to hold as a predetermined value, and when the count value reaches the predetermined value, halts transport of the transfer film 46.

When transport of the transfer film 46 stops, the first-transferred image information record portion d reaches the transfer start position N that is the nip position between the platen 31 and the heat roll 33. However, the stop position of the image information record portion d deviates from the transfer start position N due to overrun caused by characteristics of the DC motor M1 and generates an error p (see FIG. 23). Accordingly, after performing control for halting the DC motor M1 by the transfer film wind motor control section 74*c*, the image formation control section 74 successively counts clock pulses generated from the encoder 80, and thereby detects the stop position of the image information record portion d.

Then, based on the error p detected by the image formation control section 74 counting clock pulses after halt control, the card transport control section 75 corrects the driving amount of the stepping motor SM1 in next card alignment. In other words, the card transport control section 75 is beforehand set for the number of steps required for the stepping motor SM1 to rotate to transport the front end of the card K from the sensor Se4 to the transfer start position N. Then, upon receiving a count value of clock pulses indicative of the error p detected by the image formation control section 74, the card transport control section 75 converts the count value into the number of steps of the stepping motor SM1, adds the value to the beforehand set number of steps and thereby makes a correction.

Figure 23:
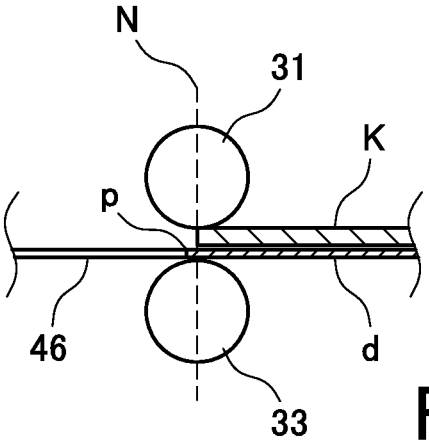
FIG. 23 shows an explanatory view of a state in which an image information record portion of the transfer film is misaligned from a transfer start position in the printing device according to the invention.
Figure 24:
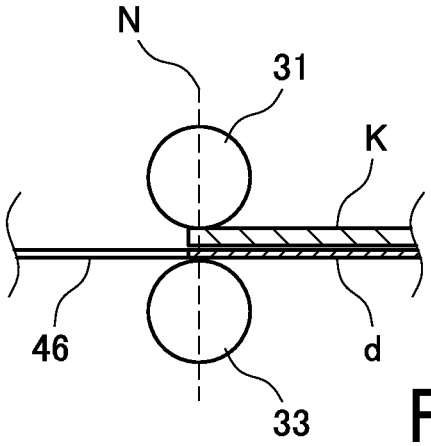
FIG. 24 shows an explanatory view of a state in which the image information record portion of the transfer film and the card front end are aligned in the printing device according to the invention.

Then, the card transport control section 75 controls rotation of the stepping motor SM1 based on the corrected step value, and as shown in FIG. 13, the card is transported to the platen 31. However, as shown in FIG. 23, the transfer film 46 deviates from the transfer start position N due to overrun of the DC motor M1, but since the driving amount of the stepping motor SM1 is corrected corresponding to the deviation of the transfer film 46, the image information record portion d of the transfer film 46 and the position of the front end of the card K do not deviate from each other as shown in FIG. 24.

Next, the image formation control section 74 of the control CPU 70 controls the shift motor drive circuit 74*d*, and shifts the heat roller 33 to the actuation position by rotation of the shift motor to be the state as shown in FIG. 14, and when the heat roller 33 comes into press-contact with the platen 31, it is possible to perform transfer with high accuracy by correct alignment.

At the time the position of the transfer film is thus determined, the alignment processing of the transfer film 46 is first performed, then the alignment processing of the card front end is performed with the deviation of the transfer film 46 stop position considered, and any misalignment does thereby not occur in the card and the image information record portion d of the transfer film 46 in transfer. Further, alignment of the transfer film 46 is first performed, and therefore, the image information record portion d does not contact the card during transport for alignment and neither rubs nor becomes damaged.

At this point, since the heat roller 33 is of material with low hardness, heat from the heat roller 33 is sufficiently conveyed even when the stop position of the film slightly deviates from the transfer start position N that is the nip position in which the heat roller 33 comes into contact with the platen 31, the deviation does thereby not affect transfer significantly, and the printing quality is maintained. In addition, in the case where the film stops out of the range (for example, ±1 mm from the transfer start position N) in which heat transmits from the heat roller 33, such a case is handled as an error, and the alignment processing is performed again.

Then, after a lapse of predicted time (beforehand set timer time or card transport amount) the card rear end passes through the heat roller 33, the image formation control section 74 of the control CPU 70 controls the shift motor drive circuit 74*d* to further rotate the shift motor a predetermined angle, and returns the heat roller 33 from the actuation position to the waiting position (FIG. 16). At this point, the peeling roller 34*b* is held in the actuation state for peeling the transfer film 46 from the card.

Thereafter, after the end of the predicted time (timer time or card transport amount) the card rear end passes through the peeling roller 34*b*, the control CPU 70 rotates again the shift motor a predetermined angle, and shifts the peeling roller 34*b* from the peeling position to the retracted position (FIG. 17). The film path comes off the medium transport path (transport path P1). At this point, the heat roller 33 is held in the waiting position.

As described above, since the DC motor M1 that drives the supply spool 47 of the film transport means does not stabilize the stop position in alignment due to overrun and the like, alignment by feeding the transfer film 46 to the transfer start position N is first performed, alignment by feeding the card front end is subsequently performed to compensate for an error p deviated due to overrun, and it is thereby possible to correctly align the image information record portion d of the transfer film 46 and the printing start position of the card with each other. By this means, it is possible to perform correct printing on the card without causing transfer unevenness. Further, the transfer film is wound around the supply and wind spools, the spool diameter varies each transfer, and therefore, the stop position is not stabilized in alignment by the film transport means. Accordingly, alignment by feeding the film-shaped medium to the transfer start position is first performed, alignment of the recording medium is subsequently performed to compensate, and it is thereby possible to correctly align the image information record portion of the film and the printing start position of the recording medium with each other.

This Embodiment shows the configuration of the retransfer type printing device for once forming an image on a transfer film and transferring the image to a card, but the invention is applicable to any printing devices (laminator, etc.) that transfer an image to a card-shaped recording medium from the transfer film.

This application claims priority from Japanese Patent Application No. 2010-165319, Japanese Patent Application No. 2011-102455 and Japanese Patent Application No. 2011-102456 incorporated herein by reference.

DESCRIPTION OF SYMBOLS

29, 30 Transport roller (medium transport means)
31 Platen
33 Heat roller (transfer roller)
34*b* Peeling roller (peeling member)
34*a*, 35*a*, 35*b* Guide roller (guide member)
40 Thermal head
41 Ink ribbon
46 Transfer film
47 Supply spool
48 Wind spool
50 Film unit (film transport means)
61 Transfer roller up-and-down means
62 Peeling member up-and-down means
63 Up-and-down frame (first shift member)
66*r* Lever (second shift member)
80 Encoder
B Image formation section
H Control means
MS Shift motor (common drive motor for driving the first and second shift members)
P1 Medium transport path (transport path)
SM2 Stepping motor
d Image information record portion

The invention claimed is:

1. A printing device for forming an image on a card-shaped recording medium, comprising: a medium transport path in which the recording medium is transported; an image formation section, provided on the medium transport path, having a platen; a medium transport device for transporting the recording medium to the image formation section; a film unit for transporting a transfer film to the image formation section, having a guide member supporting the transfer film; a transfer roller for transferring an image formed on the transfer film to the recording medium; a transfer roller up-and-down device for moving the transfer roller up and down between an actuation position in press-contact with the recording medium in the image formation section and a retracted position separated therefrom; a peeling member disposed on a downstream side in a medium transport direction of the transfer roller, and adapted to support the transfer film with the guide member, the peeling member being adapted to peel off the transfer film of which the image is transferred in the image formation section from the recording medium; a peeling member up-and-down device for moving the peeling member up and down between an actuation position for peeling off the transfer film of which the image is transferred to the recording medium in which the peeling member contacts the recording medium through the transfer film, and a retracted position for supporting the transfer film in which the peeling member is separated from the recording medium; and a control device for controlling the transfer roller member up-and-down device and the peeling member up-and-down device, wherein the control device transports the peeling member from the retracted position to the actuation position when the recording medium approaches the image formation section, performs an alignment processing for the recording medium and the transfer film to align, shifts the transfer roller to the actuation position, shifts the transfer roller from the actuation position to the retracted position after a rear end of the recording medium passes through the transfer roller, and shifts the peeling member from the actuation position to the retracted position after the rear end of the recording medium passes through the peeling member, and when the peeling member is in the retracted position, the transfer film is positioned away from the medium transport path, and when the peeling member is in the actuation position, the transfer film is positioned in the medium transport path, wherein the transfer roller and the peeling member are respectively attached to a device frame and a film cassette to shift between the respective actuation positions and respective retracted positions, and the transfer roller up-and-down device and the peeling member up-and-down device include a first shift member that shifts the transfer roller between the actuation position and the retracted position, a second shift member that shifts the peeling member between the actuation position and the retracted position, and a common drive motor that drives the first and second shift members, wherein the first shift member and the second shift member comprise: a rotating cam coupled to a rotating shaft of the drive motor, a first up-and-down member shifting the transfer roller between the actuation position and the retracted position by rotation of the rotating cam, and a second up-and-down member shifting the peeling member between the actuation position and the retracted position, wherein the transfer roller comprises a heat transfer roller for heating and transferring the image formed on the transfer film to the recording medium, the heat transfer roller includes a cover member for covering at least a part of a periphery of the roller, and the cover member is interlocked with the first up-and-down member so as to cover the periphery of the heat transfer roller when the heat transfer roller is in the retracted position, and to retract when the heat transfer roller is in the actuation position.

2. The printing device according to claim 1, further comprising: another printing device for printing an image on the transfer film, and having an ink ribbon and a thermal head to print on the transfer film carried to the image formation section.

3. The printing device according to claim 1, further comprising: a reverse unit disposed on an upstream of the medium transport path for reversing a side of the recording medium to transfer the image on another side of the recording medium, wherein the peeling member is in the retracted position for preventing the recording medium from colliding with the peeling member when the recording medium is transported toward the reverse unit for printing on said another side of the recording medium.

4. The printing device according to claim 1, further comprising: a pair of transport rollers disposed on the downstream side in the medium transport direction relative to the peeling member; and a decurl device disposed between the pair of transport rollers and pressing a center of the recording medium held between the pair of transport rollers to correct a curl of the recording medium.

5. The printing device according to claim 1, wherein the film unit comprises a film cassette detachably attached to a device frame, a pair of spools provided on the film cassette adapted to wind the transfer film, the guide member for guiding the transfer film wound around the pair of spools toward the image formation section, and the peeling member for peeling off the transfer film of which the image is transferred in the image formation section from the recording medium.

6. The printing device according to claim 1, wherein the peeling member is attached to a film cassette to shift between the actuation position for peeling off the transfer film of which the image is transferred to the recording medium and the retracted position separated from the recording medium.

7. The printing device according to claim 1, further comprising a sensor arranged between the medium transport device and the image formation section, wherein the control device controls the peeling member to stay at the retracted position while the recording medium is transported toward the sensor, and the control device transports the peeling member from the retracted position to the actuation position when the sensor detects the recording medium.

8. The printing device according to claim 1, wherein when the alignment processing for the transfer film and the recording medium to align is performed, an alignment of the recording medium is performed after an alignment of the transfer film is performed.

9. The printing device according to claim 8, further comprising: a detecting unit for detecting a stop position of the image formed on the transfer film when the alignment processing is performed, wherein in the alignment processing, the control device, after transporting the image formed on the transfer film to a transfer start position, adjusts a transport amount of transporting the recording medium to the transfer start position according to a detection result of the detecting unit.

10. A printing method comprising: a preparing step of preparing a printing device including a medium transport path in which a recording medium is transported, an image formation section, provided on the medium transport path, and having a platen, a medium transport device for transporting the recording medium to the image formation section, a film transport device for transporting a transfer film to the image formation section, and having a guide member supporting the transfer film, a film path formed by the film transport device, a transfer roller for transferring an image formed on the transfer film to the recording medium, a transfer roller up-and-down device for moving the transfer roller up and down between an actuation position in press-contact with the recording medium in the image formation section and a retracted position separated therefrom, a peeling member disposed on a downstream side in a recording medium transport direction of the transfer roller, and adapted to support the transfer film with the guide member, the peeling member being adapted to peel off the transfer film of which the image is transferred in the image formation section from the recording medium, a peeling member up-and-down device for moving the peeling member up and down between an actuation position for peeling off the transfer film from the recording medium in which the peeling member contacts the recording medium through the transfer film, and a retracted position supporting the transfer film in which the peeling member is separated from the recording medium, and a control device for controlling the medium transport device, the film transport device, the transfer roller member-up-and-down device and the peeling member up-and-down device, a peeling member transporting step of transporting the peeling member from the retracted position to the actuation position so that the transfer film is positioned in the medium transport path when the recording medium approaches the image formation section; an alignment processing step of performing alignment processing for the recording medium and the transfer film to align; a transfer roller shifting step of shifting the transfer roller to the actuation position; a transfer step of transferring the image from the transfer film to the recording medium while the transfer roller and the peeling member are at the actuation positions; a transfer roller retracting step of shifting the transfer roller from the actuation position to the retracted position after a rear end of the recording medium passes through the transfer roller; and a peeling member retracting step of shifting the peeling member from the actuation position in which the peeling member contacts the recording medium member through the transfer film to the retracted position so that the transfer film is positioned away from the medium transport path after the rear end of the recording medium passes through the peeling member, wherein the transfer roller and the peeling member are respectively attached to a device frame and a film cassette to shift between the respective actuation positions and respective retracted positions, and the transfer roller up-and-down device and the peeling member up-and-down device include a first shift member that shifts the transfer roller between the actuation position and the retracted position, a second shift member that shifts the peeling member between the actuation position and the retracted position, and a common drive motor that drives the first and second shift members, wherein the first shift member and the second shift member comprise: a rotating cam coupled to a rotating shaft of the drive motor, a first up-and-down member shifting the transfer roller between the actuation position and the retracted position by rotation of the rotating cam, and a second up-and-down member shifting the peeling member between the actuation position and the retracted position, wherein the transfer roller comprises a heat transfer roller for heating and transferring the image formed on the transfer film to the recording medium, the heat transfer roller includes a cover member for covering at least a part of a periphery of the roller, and the cover member is interlocked with the first up-and-down member so as to cover the periphery of the heat transfer roller when the heat transfer roller is in the retracted position, and to retract when the heat transfer roller is in the actuation position.

11. A printing method comprising:

a preparing step of preparing a printing device including a medium transport path in which a recording medium is transported, an image formation section, provided on the medium transport path, and having a platen, a medium transport device for transporting the recording medium to the image formation section, a film transport device for transporting a transfer film to the image formation section, and having a guide member supporting the transfer film, a film path formed by the film transport device, a transfer roller for transferring an image formed on the transfer film to the recording medium, a transfer roller up-and-down device for moving the transfer roller up and down between an actuation position in press-contact with the recording medium in the image formation section and a retracted position separated therefrom, a peeling member disposed on a downstream side in a recording medium transport direction of the transfer roller, and adapted to support the transfer film with the guide member, the peeling member being adapted to peel off the transfer film of which the image is transferred in the image formation section from the recording medium, a peeling member up-and-down device for moving the peeling member up and down between an actuation position for peeling off the transfer film from the recording medium in which the peeling member contacts the recording medium through the transfer film, and a retracted position supporting the transfer film in which the peeling member is separated from the recording medium, and a control device for controlling the medium transport device, the film transport device, the transfer roller up-and-down device and the peeling member up-and-down device, a peeling member transporting step of transporting the peeling member from the retracted position to the actuation position so that the transfer film is positioned in the medium transport path when the recording medium approaches the image formation section;

an alignment processing step of performing alignment processing for the recording medium and the transfer film to align;

a transfer roller shifting step of shifting the transfer roller to the actuation position; a transfer step of transferring the image from the transfer film to the recording medium while the transfer roller and the peeling member are at the actuation positions;

a transfer roller retracting step of shifting the transfer roller from the actuation position to the retracted position after a rear end of the recording medium passes through the transfer roller;

a peeling member retracting step of shifting the peeling member from the actuation position in which the peeling member contacts the recording medium through the transfer film to the retracted position so that the transfer film is positioned away from the medium transport path after the rear end of the recording medium passes through the peeling member;

a switchback-transporting step of transporting the recording medium toward a reverse unit after the transfer roller retracting step, the reverse unit being disposed on an upstream of the medium transport path, wherein the peeling member is in the retracted position for preventing the recording medium from colliding with the peeling member when transporting the recording medium toward the reverse unit;

a reversing step of reversing a side of the recording medium to another side of the recording medium in the reverse unit;

a shifting step of shifting the transfer roller and the peeling member to the respective actuation positions to transfer the image from the transfer film to said another side of the recording medium; and another transport step of transporting the recording medium to the image formation section, wherein the control device shifts the transfer roller from the actuation position to the retracted position after a rear end of the recording medium passes through the transfer roller, and shifts the peeling member from the actuation position to the retracted position after the rear end of the recording medium passes through the peeling member.

12. The printing method according to claim 10, wherein the film transport device comprises a film cassette detachably attached to a device frame, a pair of spools provided on the film cassette adapted to wind the transfer film, the guide member for guiding the transfer film wound around the pair of spools toward the image formation section, and the peeling member for peeling off the transfer film of which the image is transferred in the image formation section from the recording medium.

13. The printing method according to claim 10, wherein the peeling member is attached to a film cassette to shift between the actuation position for peeling off the transfer film of which the image is transferred to the recording medium and the retracted position separated from the recording medium.

14. The printing method according to claim 10, wherein after the peeling member retracting step, the peel member stays at the retracted position while another recording medium is transported toward a sensor arranged between the medium transport device and the image formation section, and in the peeling member transporting step, the peeling member is transported from the retracted position to the actuation position when the another recording medium approaches the image formation section.

15. The printing method according to claim 10, wherein in the alignment processing step of performing the alignment processing for the recording medium and the transfer film, an alignment of the recording medium is performed after an alignment of the transfer film is performed.

16. The printing method according to claim 15, wherein in the alignment processing step of performing the alignment processing for the recording medium and the transfer film, a detecting unit detects a stop position of the image formed on the transfer film so that after the image formed on the transfer film is transported to a transfer start position, the control device adjusts a transport amount to transport the recording medium to the transfer start position according to a detection result of the detecting unit.

* * * * *